US010421287B2

(12) United States Patent
Yamazaki et al.

(10) Patent No.: US 10,421,287 B2
(45) Date of Patent: Sep. 24, 2019

(54) LIQUID EJECTION HEAD AND LIQUID EJECTION APPARATUS

(71) Applicant: CANON KABUSHIKI KAISHA, Tokyo (JP)

(72) Inventors: Takuro Yamazaki, Inagi (JP); Toru Nakakubo, Kawasaki (JP); Kazuhiro Yamada, Yokohama (JP); Yoshiyuki Nakagawa, Kawasaki (JP); Yoshihiro Hamada, Yokohama (JP); Koichi Ishida, Tokyo (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,667

(22) Filed: May 30, 2018

(65) Prior Publication Data

US 2019/0001698 A1 Jan. 3, 2019

(30) Foreign Application Priority Data

Jun. 29, 2017 (JP) ..... 2017-127563

(51) Int. Cl.
*B41J 2/18* (2006.01)
*B41J 2/14* (2006.01)

(52) U.S. Cl.
CPC ..... *B41J 2/18* (2013.01); *B41J 2/1404* (2013.01); *B41J 2/14145* (2013.01); *B41J 2002/14459* (2013.01); *B41J 2202/12* (2013.01); *B41J 2202/21* (2013.01)

(58) Field of Classification Search
CPC ..... B41J 2/18; B41J 2/1404; B41J 2/14145; B41J 2202/21; B41J 2002/14459; B41J 2202/12
See application file for complete search history.

(56) References Cited

U.S. PATENT DOCUMENTS

| | | | |
|---|---|---|---|
| 8,517,518 | B2 | 8/2013 | Kashu et al. |
| 8,636,349 | B2 | 1/2014 | Nakakubo et al. |
| 9,254,658 | B2 | 2/2016 | Yamada et al. |
| 9,452,606 | B2 | 9/2016 | Yamada |
| 9,469,111 | B2 | 10/2016 | Yamada et al. |
| 9,744,760 | B2 | 8/2017 | Yamada et al. |
| 9,931,845 | B2 | 4/2018 | Moriya et al. |
| 9,962,937 | B2 | 5/2018 | Okushima et al. |
| 2011/0267407 | A1 | 11/2011 | Yoshida et al. |

(Continued)

FOREIGN PATENT DOCUMENTS

| | | |
|---|---|---|
| EP | 0 575 983 A2 | 12/1993 |
| EP | 0 737 580 A2 | 10/1996 |

(Continued)

OTHER PUBLICATIONS

U.S. Appl. No. 15/976,470, Kazuhiro Yamada Toru Nakakubo Yoshiyuki Nakagawa Shingo Okushima, filed May 10, 2018.

(Continued)

*Primary Examiner* — Geoffrey S Mruk
(74) *Attorney, Agent, or Firm* — Venable LLP

(57) ABSTRACT

A plurality of pressure chambers are formed in a circulation channel for liquid in order to array ejection ports in a high density in association with the circulation channel. The circulation channel is connected to a penetration supply path and a penetration recovery path that penetrate a substrate.

16 Claims, 20 Drawing Sheets

(56) References Cited

U.S. PATENT DOCUMENTS

| | | | | |
|---|---|---|---|---|
| 2012/0113197 | A1* | 5/2012 | Kashu | B41J 2/1404 347/89 |
| 2015/0239241 | A1 | 8/2015 | Maher et al. | |
| 2017/0197409 | A1 | 7/2017 | Okushima et al. | |
| 2017/0197419 | A1 | 7/2017 | Okushima et al. | |
| 2017/0197439 | A1 | 7/2017 | Okushima et al. | |
| 2017/0232737 | A1 | 8/2017 | Komamiya et al. | |
| 2017/0274647 | A1 | 9/2017 | Aoki et al. | |
| 2017/0313076 | A1 | 11/2017 | Okushima et al. | |
| 2017/0341398 | A1 | 11/2017 | Tamenaga et al. | |

FOREIGN PATENT DOCUMENTS

| | | | |
|---|---|---|---|
| JP | 2012-061717 | A | 3/2012 |
| WO | 2015/163069 | A1 | 10/2015 |
| WO | 2016/175865 | A1 | 11/2016 |

OTHER PUBLICATIONS

U.S. Appl. No. 15/995,493, Toru Nakakubo Takuro Yamazaki Kazuhiro Yamada Yoshiyuki Nakagawa, filed Jun. 1, 2018.

U.S. Appl. No. 16/000,238, Yoshiyuki Nakagawa Takuro Yamazaki Kazuhiro Yamada Toru Nakakubo, filed Jun. 5, 2018.

U.S. Appl. No. 16/006,312, Takuro Yamazaki Toru Nakakubo Kazuhiro Yamada Yoshiyuki Nakagawa Akiko Hammura, filed Jun. 12, 2018.

U.S. Appl. No. 16/014,600, Akiko Hammura Yoshiyuki Nakagawa, filed Jun. 21, 2018.

U.S. Appl. No. 16/018,454, Kazuhiro Yamada Shuzo Iwanaga Seiichiro Karita Shingo Okushima Zentaro Tamenaga Noriyasu Nagai Tatsurou Mori Akio Saito Akira Yamamoto Asuka Horie Masao Furukawa Takatsuna Aoki, filed Jun. 26, 2018.

Extended European Search Report dated Nov. 6, 2018, in European Patent Application No. 18176217.0.

* cited by examiner

LIQUID EJECTION HEAD AND LIQUID EJECTION APPARATUS

BACKGROUND OF THE INVENTION

Field of the Invention

The present invention relates to a liquid ejection head capable of ejecting liquid such as ink and a liquid ejection apparatus.

Description of the Related Art

International Laid-Open No. WO 2016/175865 discloses, as a liquid ejection head, an ink jet print head that can pressurize liquid ink supplied into a pressure chamber by means of an ejection energy generating element so as to eject the ink staying in the pressure chamber through an ejection port. In the print head, a circulation path, through which the ink staying in the pressure chamber is circulated, is formed on a substrate at the surface at which the pressure chamber is formed. The circulation path includes two pressure chambers. The circulation path is formed in such a manner as to correspond to a set consisting of the plurality of pressure chambers. In other words, the circulation path is formed at the surface of the substrate by a number in proportion to the number of pressure chambers. Circulating the ink staying in the pressure chamber is effective in suppressing deficient ejection of the ink caused by the increased viscosity of the ink as a result of the evaporation of volatile components contained in the ink through the ejection ports.

In the ink jet print head disclosed in International Laid-Open No. WO 2016/175865, the pressure chambers, the circulation paths, and circulating elements for circulating the ink are formed at one and the same surface of the substrate. The circulation paths and the circulating elements need to be formed by a number corresponding to the number of pressure chambers. In addition, a supply path, through which the ink is supplied to the pressure chambers and the circulation paths, is positioned at one and the same surface of the substrate at which the pressure chambers, the circulation paths, and the circulating elements are formed. Consequently, it is difficult to arrange the ejection ports in a high density.

SUMMARY OF THE INVENTION

The present invention provides a liquid ejection head capable of arraying ejection ports in a high density in association with circulation paths for liquid, and a liquid ejection apparatus.

In the first aspect of the present invention, there is provided a liquid ejection head comprising:

a substrate having a first surface and a second surface opposite to the first surface;

a circulation channel provided on a side of the first surface of the substrate;

a pressure chamber provided on the side of the first surface of the substrate, liquid being circulated through the pressure chamber; and an ejection energy generating element provided on the side of the first surface of the substrate, the ejection energy generating element generating energy for ejecting liquid in the pressure chamber from an ejection port, wherein the substrate includes:

a penetration supply path configured to penetrate between the first surface and second surface of the substrate so as to supply liquid to the circulation channel; and a penetration recovery path configured to penetrate between the first surface and second surface of the substrate so as to recover liquid from the circulation channel, wherein the pressure chamber is provided in a plural number in series in the circulation channel, and wherein the circulation channel includes a first supply path configured to supply ink, having a first pressure, to a first position of the circulation channel, and a second supply path configured to supply ink, having a second pressure different from the first pressure, to a second position of the circulation channel different from the first position.

In the second aspect of the present invention, there is provided a liquid ejection apparatus comprising:

the liquid ejection head according to the first aspect of the present invention;

a supply unit configured to supply liquid to the circulation channel of the liquid ejection head; and a control unit configured to control the ejection energy generating element.

According to the present invention, the circulation paths for liquid are efficiently formed, and the ejection ports can be arrayed in a high density.

Further features of the present invention will become apparent from the following description of exemplary embodiments with reference to the attached drawings.

DESCRIPTION OF THE EMBODIMENTS

Embodiments of the present invention will be described below with reference to the attached drawings. A liquid ejection head and a liquid ejection apparatus in the embodiments below are exemplified by an ink jet print head and an ink jet printing apparatus, respectively.

First Embodiment

Figure 1:
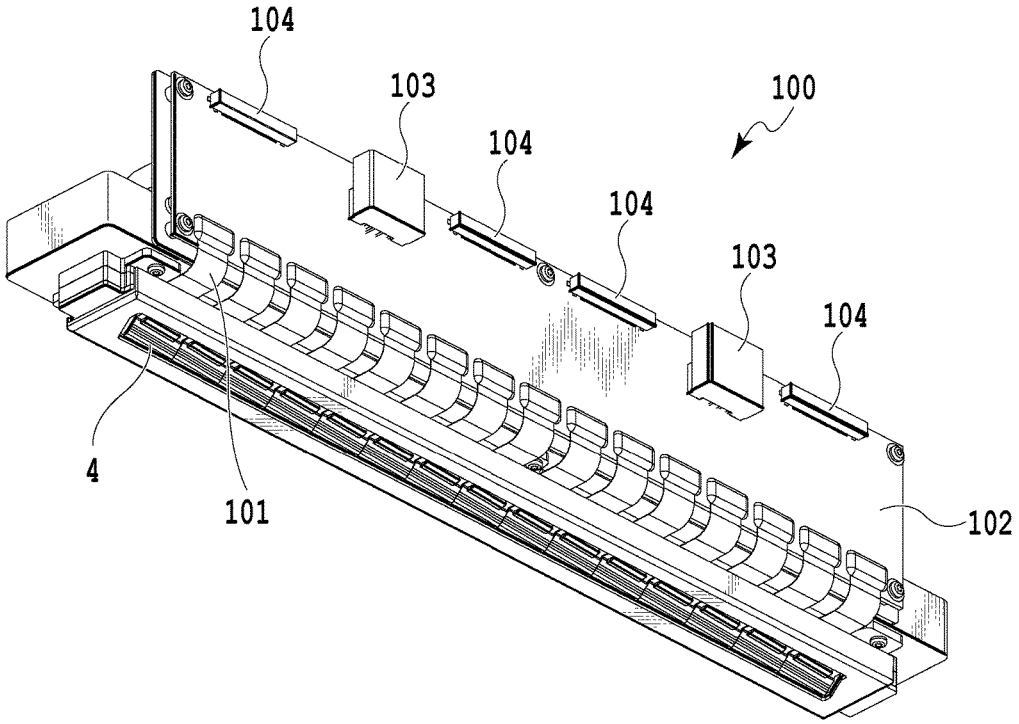
FIG. 1 is a perspective view showing a print head in a first embodiment of the present invention.

FIG. 1 is a perspective view showing an ink jet print head 100 serving as a liquid ejection head. The print head 100 in the present embodiment includes a substrate 4, an electric wiring substrate 102 electrically connected to the substrate 4 via a flexible wiring substrate 101, and power supply terminals 103 and signal input terminals 104 that are used for the ejection control of ink (liquid). Examples of a system for supplying ink to the print head 100 include a system for supplying ink into a pressure chamber inside of the print head 100 from one ink tank by using a capillary phenomenon or a pump. There is another system in which ink tanks are disposed upstream and downstream of a path, on which ink is supplied to the print head, respectively, and then, the ink is allowed to flow from one of the ink tanks to the other ink tank so as to supply ink into a pressure chamber in the print head.

Figure 2A:
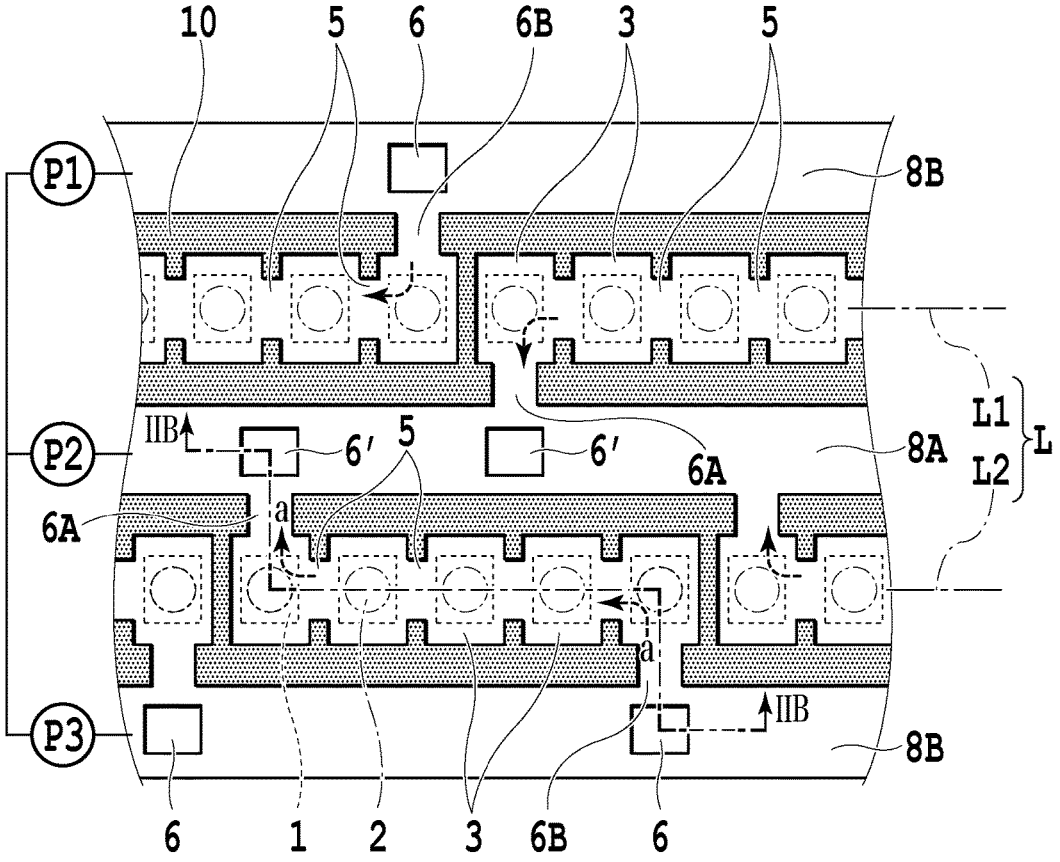
FIG. 2A is a diagram illustrating a substrate in the print head shown in FIG. 1.
Figure 2B:
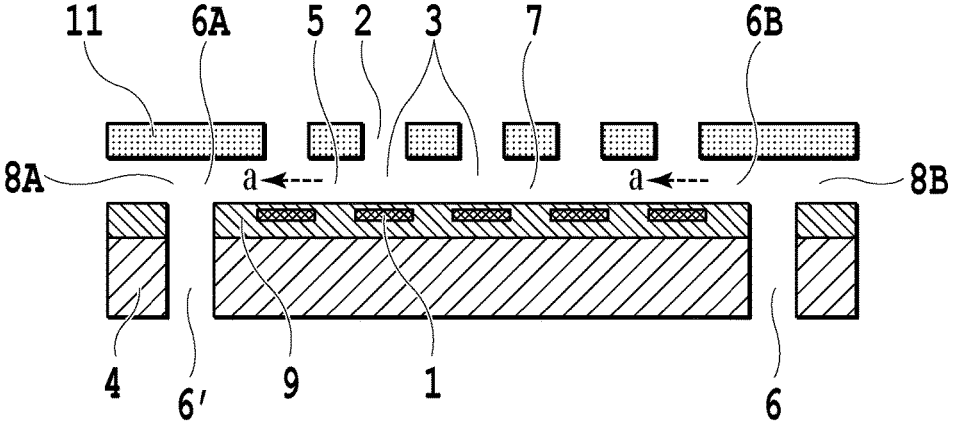
FIG. 2B is a cross-sectional view taken along a line IIB-IIB of FIG. 2A.

FIG. 2A is an enlarged view schematically showing a part of the substrate 4. FIG. 2B is a cross-sectional view taken along a line IIB-IIB of FIG. 2A. The substrate 4 has a first surface and a second surface opposite to the first surface. FIG. 2A is a view showing the substrate 4, as viewed from a position facing the first surface. At the first surface of the substrate 4, two ejection port arrays L (L1 and L2) are formed, wherein a plurality of ejection ports 2 are arrayed at a pitch corresponding to a resolution of 600 dpi. The ejection ports 2 on one ejection port array L1 and the ejection ports 2 on the other ejection port array L2 are shifted at a half pitch in the direction of the arrays. In this manner, the print head 100 is configured such that it has a print resolution of 1200 dpi and a print width of 20 mm. The print head 100 in the present embodiment is of an elongated full-line type, in which the plurality of substrates 4 are arranged in such a manner as to correspond to a print medium of an A4 size or the like. The print head 100 may be of a serial scan type having a head width smaller than the width of a print medium.

A plurality of electrothermal transducers (hereinafter also referred to as "heaters") 1 as ejection energy generating elements are arranged in a functional layer 9 on the substrate 4. The ink ejection ports 2 and pressure chambers 3 are formed at positions opposite to the heaters 1. The plurality of adjacent pressure chambers 3 (five pressure chambers in the present embodiment) communicate with each other to form a series of channels via connection channels 5. The pressure chamber 3 positioned at one end of the series of channels is connected to an ink supply path 8A through a connection port 6A whereas the pressure chamber 3 positioned at the other end of the series of channels is connected to an ink supply path 8B through a connection port 6B. Ink staying in the pressure chamber 3 is ejected through the ejection port 2 by the generation energy of the heater 1 serving as the ejection energy generating element. The plurality of pressure chambers 3 are continuously connected between the connection ports 6A and 6B, thereby forming a circulation channel 7, through which the ink flows in circulation. The pressure chambers 3 are defined at the first surface of the substrate 4 by a channel forming member 10 and the ejection ports 2 are defined by an ejection port forming member 11. The channel forming member 10 and the ejection port forming member 11 may be integrated with each other. The plurality of ejection ports 2 are arrayed, thus forming the ejection port arrays L1 and L2. The ejection port arrays L1 and L2 are disposed along the circulation channel 7. Members (e.g., columnar structures) constituting filters for suppressing the intrusion of foreign matter such as air bubbles into the pressure chambers 3 may be interposed between the supply paths 8A and 8B and the connection ports 6A and 6B.

The connection port 6A of the circulation channel 7 at the ejection port array L1 and the connection port 6A of the circulation channel 7 at the ejection port array L2 are connected to the supply path 8A interposed between the ejection port arrays L1 and L2. Moreover, the connection port 6B of the circulation channel 7 at the ejection port array L1 is connected to the upper supply path 8B in FIG. 2A whereas the connection port 6B of the circulation channel 7 at the ejection port array L2 is connected to the lower supply path 8B in FIG. 2A. The ink is supplied to the supply paths 8A and 8B by pumps provided outside of the print head 100. The pumps and the supply paths 8A and 8B are connected via penetration supply paths 6 for supplying the ink to the circulation channel 7 and penetration recovery paths 6' for recovering the ink from the circulation channel 7. The penetration supply paths 6 are opened to the supply path 8B whereas the penetration recovery paths 6' are opened to the supply path 8A. The penetration supply path 6 and the penetration recovery path 6' are paths that penetrate between the first surface and second surface of the substrate 4. The ink is supplied from the second surface of the substrate 4 to the first surface through the penetration supply path 6, passes the circulation channel 7, and then, is recovered to the second surface of the substrate 4 from the first surface through the penetration recovery path 6'. The penetration supply path 6 and the penetration recovery path 6' are connected to the second surface of the substrate 4 or to the outside of the substrate 4, thus circulating the ink there-through. The pressure of the ink supplied to the supply path 8B is set to be higher than that of the ink supplied to the supply path 8A. The difference in pressure causes the flow (the circulation flow) of the ink in a direction indicated by an arrow "a" toward the supply path 8A from the supply path 8B through the circulation channel 7. According to the present invention, the use of the penetration supply path 6 and penetration recovery path 6' equips the second surface of the substrate 4 or the outside of the substrate 4 with the functions of the channels and the like required for allowing the ink to flow through the circulation channel 7. As a consequence, it is possible to secure space at the first surface of the substrate 4, thus arraying the ejection ports 2 in a higher density.

The ink circulates through the pressure chambers 3 formed in the same circulation channel 7 at the same flow rate. As a consequence, by achieving the circulation flow rate of the ink required for one ejection port 2 in the circulation channel 7, the deterioration (deterioration caused by the evaporation of volatile components contained in the ink) of the ink near the plurality of ejection ports at the single circulation channel 7 can be suppressed at the same time. Deteriorated ink flows from the vicinity of the upstream ejection ports to the downstream of the circulation channel 7. However, the flow rate of the deteriorated ink is smaller than that of the circulating ink, and therefore, an adverse influence is hardly exerted on the deterioration suppression effect of the ink near the ejection ports downstream of the circulation channel 7. The circulation flow rate of the ink required for the single circulation channel 7 does not increase in proportion to the number of ejection ports 2. Thus, the circulation flow rate required for one ejection port 2 can suppress the deterioration of the ink.

In the constitutional example illustrated in FIG. 2A and FIG. 2B, the five pressure chambers 3 are arranged in series in the single circulation channel 7. The number of pressure chambers 3 arranged in the single circulation channel 7 (i.e., pressure chambers arranged in series in the circulation channel) is simply required to be two or more. As the number of pressure chambers 3 arranged in the single circulation channel 7 becomes greater, channel resistance at the circulation channel 7 becomes greater. In view of this, it is necessary to widen a difference in pressure between the supply paths 8A and 8B in order to achieve the same circulation flow rate of the ink. Accordingly, the pump connected to the print head 100 requires a higher ability, thereby inducing a larger size of an ink jet printing apparatus. In addition, the ejection ports arrayed downstream of the circulation channel 7 are significantly influenced by the deterioration of the ink flowing near the ejection ports upstream of the circulation channel 7. From the above-described viewpoint, the number of pressure chambers formed in series in the circulation channel should be preferably three or more.

In contrast, if the number of pressure chambers 3 formed in the single circulation channel 7 is smaller, the number and total formation area of connection ports 6A and 6B to be formed increase. As a consequence, the arrangement area of, for example, a drive circuit for the heater 1 is restricted, thereby making it difficult to array the ejection ports 2 in a high density. Consequently, the size of the substrate 4 increases. In view of this, it is preferable to determine the number of pressure chambers 3 formed in the single circulation channel 7 based on the interrelationship among the effect of the suppression of ink deterioration, the pressure of the ink for achieving the required circulation flow rate of the ink, and the array of the ejection ports 2 in a high density (the highly dense array of nozzles). The upper limit of the number of pressure chambers 3 formed in the single circulation channel 7 should be preferably ten or less, and more preferably, it should be five or less, although it depends on its shape or the like. From the viewpoint of the small deterioration distribution of the ink flowing between the ejection ports and the highly dense array of the ejection ports, the number of pressure chambers 3 formed in the single circulation channel 7 should be preferably two or more and five or less. More preferably, it should be three or more. It is simply necessary that the pressure chambers 3 should be formed such that the circulation channel 7 is aligned between the connection ports 6A and 6B without any branches or confluences. The ejection ports 2 and the pressure chambers 3 do not need to be aligned.

In the present embodiment, the area of the heater 1 is 750 $\mu m^2$ (=25 μm×30 μm); the diameter of the ejection port 2 is 25 μm; the cross-sectional area of the pressure chamber 3 is 1050 $\mu m^2$ (=30 μm×35 μm); the width of the connection channel 5 is 20 μm; and the length of the connection channel 5 is 10 μm. Additionally, the width of each of the connection ports 6A and 6B is 20 μm; the length of each of the connection ports 6A and 6B is 20 μm; the height of the circulation channel 7 is 20 μm; and the width of each of the supply paths 8A and 8B is 50 μm. Moreover, the thickness of the ejection port forming member 11 is 20 μm; the viscosity of the ink is 2 cP; and the ejection quantity of the ink from the ejection port 2 is 10 pL. The heater 1 serving as the ejection energy generating element is electrically connected to the electric wiring substrate 102 shown in FIG. 1 through the electric wires and the terminals that are formed on the substrate 4.

The heater 1 is driven to generate heat in response to a pulse signal output from a print control circuit, not shown. The heat generated by the heater 1 produces bubbles in the ink staying inside of the pressure chamber 3, and furthermore, the resultant bubble energy ejects the ink from the ejection port 2. The pressure chamber 3 is space defined by the channel forming member 10 and the ejection port forming member 11. By supplying the ink of the same color to the four ejection port arrays L that are formed in the same manner as the ejection port arrays L1 and L2, an image in a single color can be printed. The ejection port arrays L may be formed on the single substrate 4 or may be formed on the plurality of substrates 4.

(Ejection Control of Ink)

In a case where the heater 1 under one of the plurality of pressure chambers 3 formed in the same circulation channel 7 gives ejection energy to the ink staying in the pressure chamber 3, the ejection energy is liable to be propagated in the pressure chamber adjacent to the single pressure chamber 3 (hereinafter also referred to as an "adjacent pressure chamber"). The propagation of the ejection energy (crosstalk) changes the position of a meniscus of the ink (the position of the ink level), formed at the ejection port 2 in the adjacent pressure chamber 3. In a case where the ink is ejected from the ejection port in the adjacent pressure chamber 3 in the state in which the influence of the crosstalk remains large, the ejection quantity and direction of the ink change, thereby incurring the possibility of shift of the landing position of the ink on a print medium.

After the ink is ejected from the ejection ports 2 in the single pressure chamber 3, the circulation channel 7 is filled again with the ink flowing through the supply paths 8A and 8B via the pressure chamber 3 adjacent to the single pressure chamber 3. Although time required for refilling the ink depends on the dimensions and structures of the circulation channel 7, connection ports 6A and 6B, supply paths 8A and 8B, and the like, it takes about 10 μsec to about 250 μsec. During this time, the flow of the ink in the circulation channel 7 is largely disturbed, thereby changing the ink level at the ejection ports 2. In this manner, in the case where the ink is ejected in the state in which the influence of the crosstalk remains large, the ejection quantity and direction of the ink change, thereby incurring the possibility of the shift of the landing position of the ink on a print medium.

As described above, the plurality of pressure chambers 3 formed in the single circulation channel 7 influence each other in the print head 100 at the time of ink ejection operation. In view of this, it is important to control the ejection timing of the ink from the plurality of pressure chambers 3 formed in the single circulation channel 7.

Figure 3:
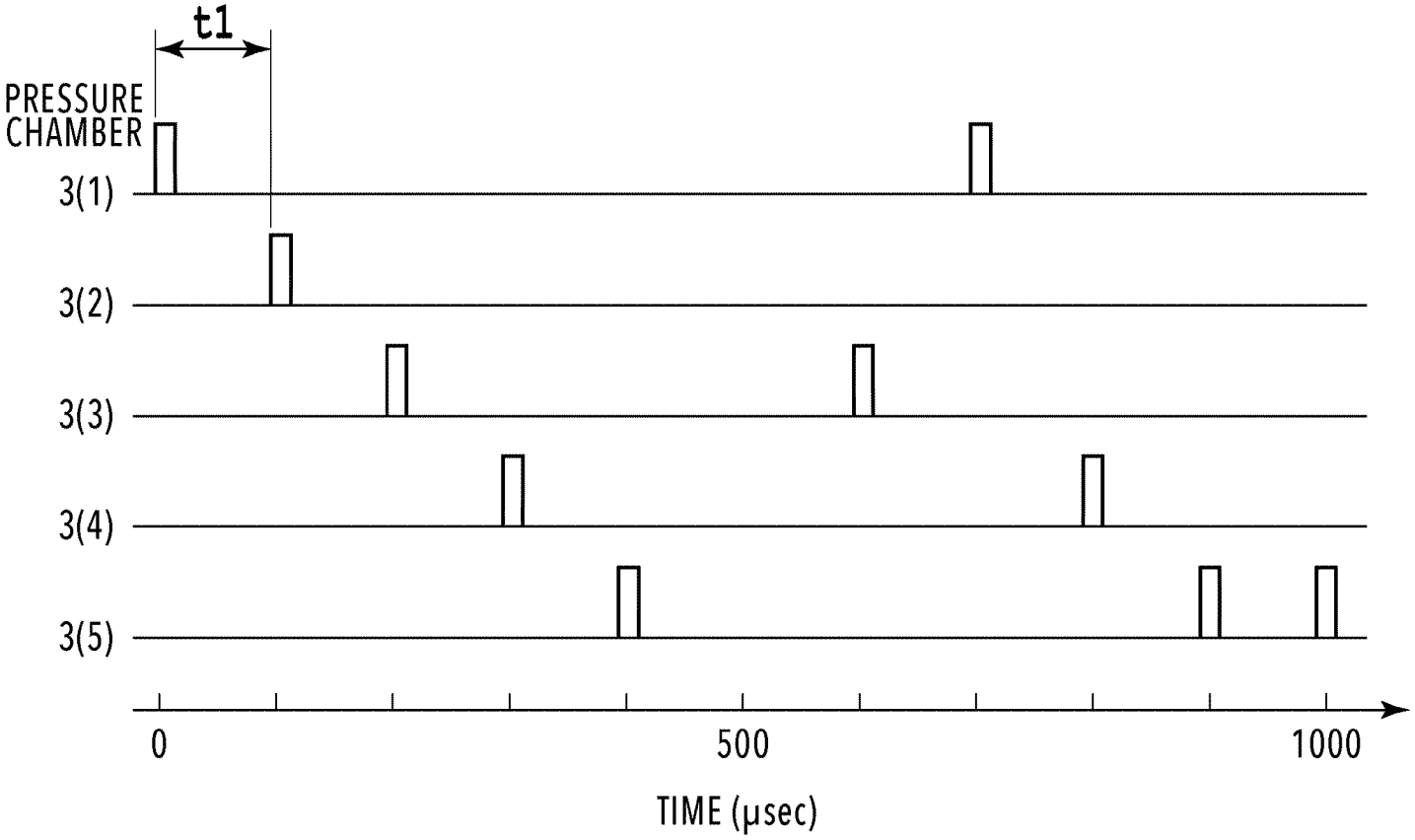
FIG. 3 is a timing chart illustrating ink ejection control in the print head shown in FIG. 1.

FIG. 3 is a timing chart illustrating ink ejection control in the print head 100. In the present embodiment, since the five pressure chambers 3 are formed in the single circulation channel 7, the pressure chambers 3 are numbered at 3(1), 3(2), 3(3), 3(4), and 3(5) in FIG. 3. The horizontal axis represents a drive timing of the heater 1 in the pressure chambers. In the present embodiment, the fluctuations of the pressure and the refilling of the ink according to the ink ejection operation in one of the pressure chambers 3 influence the other four pressure chambers 3. It is preferable to perform the next ejection operation when the circulation flow of the ink in the circulation channel 7 becomes stable to such an extent that the ejection quantity and direction of the ink are not influenced.

In FIG. 3, the ejection timing of the ink at which the proper ejection quantity and landing accuracy of the ink can be ensured is expressed by an interval t1. In the present embodiment, the ejection timings of the ink at the five pressure chambers 3 formed in the single circulation channel 7 are shifted in order to ensure the interval t1. In this case, any ejection orders of the ink at the pressure chambers 3 and any continuity of the ink ejection operations are allowed. One scale in the horizontal axis in FIG. 3 is calibrated in 100 μsec increments.

As the interval t1 becomes longer, the number of ejection times of the ink per unit time becomes smaller, thereby reducing a print speed or the print resolution of an image. In view of this, it is preferable to set the interval t1 to a requisite minimum value. For this purpose, it is important to form the pressure chamber 3 into a substantial closed space so as to suppress crosstalk between pressure chambers caused by the ink ejection operation and to increase the cross-sectional area of an ink channel so as to speed up the refilling of the ink. FIG. 3 illustrates one example of the ink ejection control. Moreover, the ink can be ejected from the plurality of pressure chambers 3 formed in the circulation channel 7 at the same time according to the design of the circulation channel 7 and the required ejection accuracy of the ink.

In the configuration of the circulation channel 7 in which the adjacent pressure chamber 3 is susceptible to the ink ejection operation, the interval t1 between the ejection timings of the ink from the plurality of pressure chambers 3 formed in the circulation channel 7 becomes long, thereby prolonging the ejection cycle of the ink. In this case, the print speed, particularly, largely decreases when an image of a high resolution is printed. In view of this, it is important to design the structure of the circulation channel 7 so as to shorten the interval t1 between the ejection timings of the ink. It is preferable to reduce the channel resistance of the circulation channel 7 and increase the channel resistance among the pressure chambers 3 so as to increase the print speed. However, these are design elements contradictory to each other. In view of this, in consideration of the ejection stability of the ink, the highly dense array of the ejection ports 2, and the required ejection rate of the ink, the number of pressure chambers 3 formed in the single circulation channel 7 is determined, and furthermore, the structure including the dimension of the circulation channel 7 is designed.

(Control of Circulation Flow of Ink)

To the supply path 8B is connected a first supply source, not shown, for supplying the ink having a pressure P1 through the penetration supply path 6 and the penetration recovery path 6' that penetrate the substrate 4 and the functional layer 9. To the supply path 8A is connected a second supply source, not shown, for supplying the ink having a pressure P2 smaller than the pressure P1 through the penetration supply path 6 and the penetration recovery path 6' that penetrate the substrate 4 and the functional layer 9. As a consequence, the ink flow in the direction indicated by the arrow "a" in FIG. 2B from the connection port 6B to the connection port 6A on the circulation channel 7 is caused by the difference (P1−P2) in pressure. In the present embodiment, the difference (P1−P2) in pressure is 200 mmAq. The ink flow (the circulation flow) caused by the difference in pressure is produced in the plurality of pressure chambers 3 formed in the circulation channel 7, thus supplying fresh ink near the ejection ports 2 in each of the pressure chambers 3 all the time. The first and second supply sources may be configured by using, for example, a vacuum pump, a pressure adjustor, and an air chamber in combination and the height difference of the ink.

In this manner, the ink flow in the circulation channel 7 is caused by the difference (P1−P2) in pressure also during non-print operation in which no ink is ejected from the ejection ports 2, thus supplying the fresh ink near the pressure chambers 3 and the ejection ports 2. Even during non-print operation, no ink resides near the ejection ports 2, thus curbing the adverse influence of the deterioration of the ink near the ejection ports 2 (the deterioration caused by the evaporation of volatile components contained in the ink) on the ejection quantity and landing accuracy of the ink.

Since the circulation flow of the ink for suppressing the deterioration of the ink is produced on the circulation channel connecting the plurality of pressure chambers to each other, the space required for forming the circulation channel can be reduced without any increase in proportion to the number of ejection ports. The circulation channel of the ink can be efficiently formed even in a print head having numerous ejection ports. Since the first droplet of the ink is ejected from the ejection ports, the ejection status of the ink can be stabilized by suppressing the deterioration of the ink by the effect of the above-described circulation channel. Furthermore, it is possible to reduce the variations of the landing position of the ink. Additionally, it is possible to array the ejection ports in a high density while efficiently forming the circulation channel of the ink so as to achieve the miniaturization of the substrate.

Second Embodiment

The basic configuration of a print head 100 in the present embodiment is identical to that in the above-described first embodiment, and therefore, the characteristic configuration of the present embodiment will be described below.

Figure 4A:
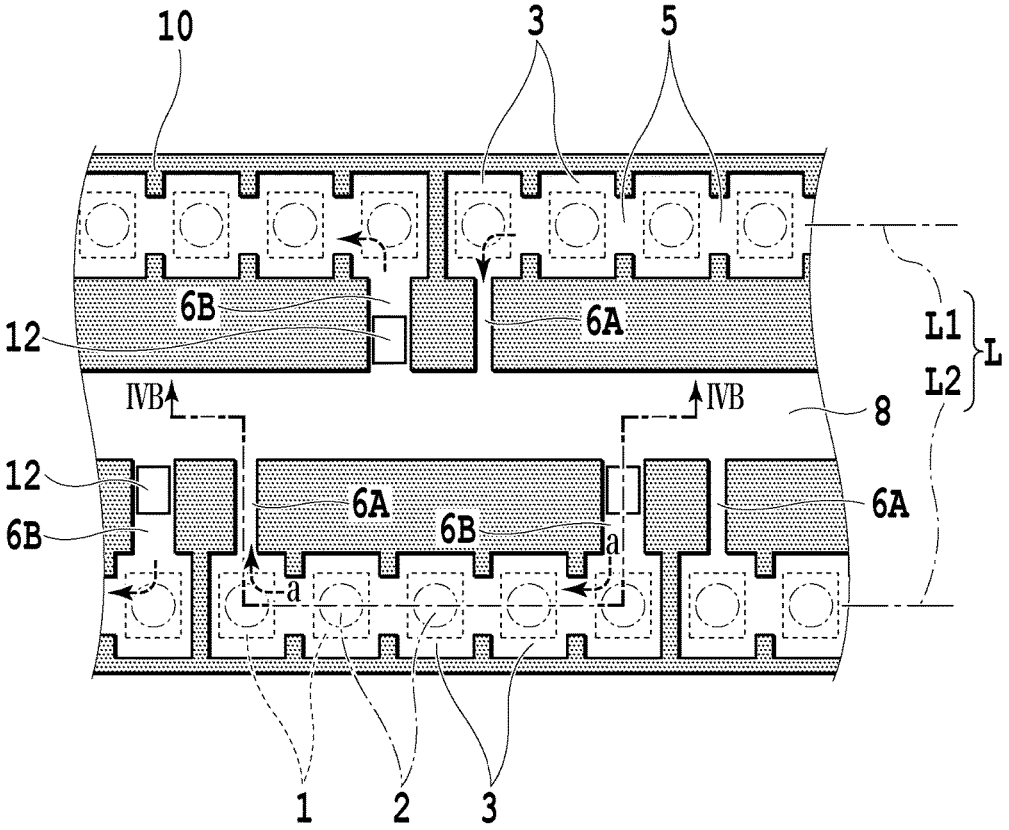
FIG. 4A is a diagram illustrating a substrate in a print head in a second embodiment of the present invention.
Figure 4B:
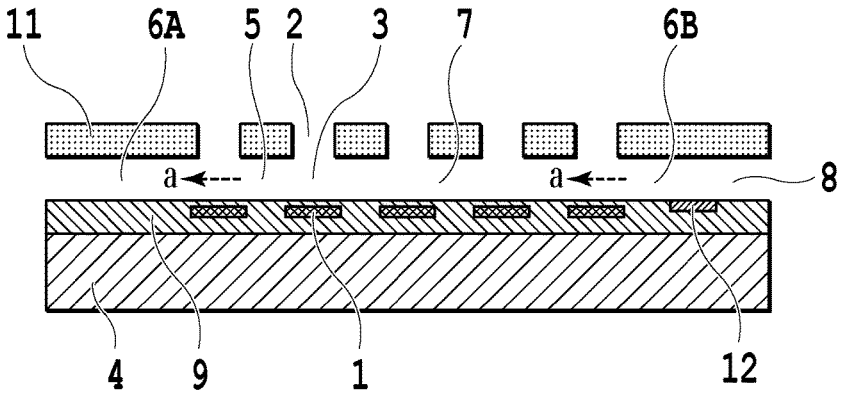
FIG. 4B is a cross-sectional view taken along a line IVB-IVB of FIG. 4A.

FIG. 4A is a schematic diagram illustrating a substrate 4 in the present embodiment; and FIG. 4B is a cross-sectional view taken along a line IVB-IVB of FIG. 4A. Like in the first embodiment, a plurality of ejection ports 2 are arrayed in each of two ejection port arrays L1 and L2 at a pitch corresponding to a resolution of 600 dpi. The ejection ports 2 in the ejection port arrays L1 and L2 are shifted from each other at a half pitch in the direction of the arrays, thus achieving a print resolution of 120 dpi. The print width of the print head 100 is 25 mm. The substrate 4 having 256 to 2048 ejection ports 2 is a single unit. A plurality of units are arranged, thus forming an ejection port array having as many ejection ports 2 as possible arrayed thereon.

In the present embodiment, a circulation channel 7 is connected to a single supply path 8 via connection ports 6A and 6B, and furthermore, the connection port 6B is provided with a liquid delivery mechanism (a fluid mechanism) 12 for ink. Moreover, a penetration supply path and a penetration recovery path are formed on the supply path 8. The penetration supply path and penetration recovery path are connected to an ink tank, not shown. The penetration supply path and the penetration recovery path are formed outside of the area of the print head 100 illustrated in FIG. 4A and FIG. 4B, and therefore, they are not illustrated in FIG. 4A and FIG. 4B. The connection port 6B has a width of 20 μm and a length of 50 μm. The connection port 6A has a width of 10 μm and a length of 50 μm. The connection port 6B having the liquid delivery mechanism 12 formed thereat has a smaller channel resistance than that of the connection port 6A. Channel resistance varies in the channel from the liquid delivery mechanism 12 to the supply path 8. The other dimensions are identical to those in the first embodiment. The liquid delivery mechanism 12 feeds fresh ink from the supply path 8 to the connection port 6B, thus producing a circulation flow of the ink in the circulation channel 7 in a direction indicated by an arrow "a" in FIG. 4B. Any liquid delivery mechanisms 12 can be used as long as they may supply the ink from the supply path 8 into the circulation channel 7, and therefore, the configuration is not limited. For example, elements capable of delivering ink such as a resistance type heater, a piezoelectric actuator, an electrostatic actuator, and a mechanical/impact drive type actuator may be used. The liquid delivery mechanism 12 in the present embodiment supplies the ink by the use of a piezoelectric actuator that changes the volume of a channel at the connection port 6B.

Figure 5:
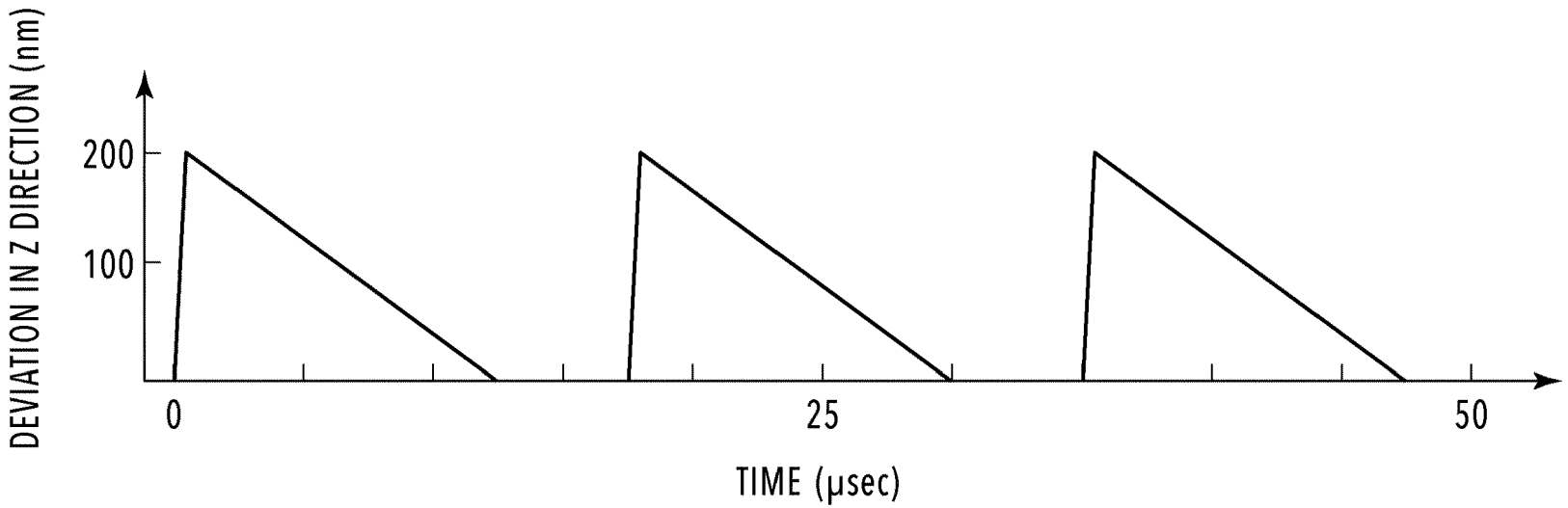
FIG. 5 is a timing chart illustrating the control of a liquid delivery mechanism illustrated in FIG. 4A.

FIG. 5 is a timing chart illustrating the drive timing of the liquid delivery mechanism 12. The vertical axis in FIG. 5 represents the deviation of the piezoelectric actuator in the liquid delivery mechanism 12 in a height direction (a Z direction) of the connection port 6B, and represents the transition of the deviation in the height direction of the piezoelectric actuator with respect to time represented by the horizontal axis. A direction in which the deviation in the height direction increases is plus. The piezoelectric actuator in the liquid delivery mechanism 12 deviates in the height direction, thus reducing the inner volume of the channel at the connection port 6B so as to feed fresh ink from the supply path 8 to the connection port 6B.

The channel resistance from the connection port 6A to the supply path 8 is greater than that from the connection port 6B to the supply path 8. The liquid delivery mechanism 12 is deviated asymmetrically with respect to time, as illustrated in, for example, FIG. 5, in order to efficiently supply fresh ink from the supply path 8 to the circulation channel 7. The liquid delivery mechanism 12 repeats the deviation in the Z direction illustrated in FIG. 5. When the deviation is abrupt, the ink staying in the circulation channel 7 is pushed out toward the connection port 6A and the connection port 6B by the amount equivalent to the deviation of the liquid delivery mechanism 12. At this time, the ink is pushed out, in a larger quantity, toward the connection port 6B having a smaller channel resistance in a larger quantity. In contrast, when the deviation of the liquid delivery mechanism 12 is moderate, the ink is supplied preferentially to the circulation channel 7 from the connection port 6B having a smaller channel resistance, thus restricting the ink supply quantity from the connection port 6A having a greater channel resistance. In terms of the connection port 6B, the quantity of the ink supplied into the circulation channel 7 during the moderate deviation of the liquid delivery mechanism 12 is more than that of the ink pushed out from the circulation channel 7 during the abrupt deviation of the liquid delivery mechanism 12, thus producing a flow inside of the circulation channel 7 in the direction indicated by the arrow "a" illustrated in FIG. 4B. In this manner, the use of the asymmetric deviation drive of the liquid delivery mechanism 12 and the asymmetric channel resistance in the channel from the liquid delivery mechanism 12 to the supply path 8 can produce the ink circulation flow inside of the circulation channel 7 according to the deviation of the liquid delivery mechanism 12.

The drive timing of the liquid delivery mechanism 12 is not particularly restricted. The liquid delivery mechanism 12 may be sequentially operated or may be operated in association with the ink ejection operation at a timing before the ink is ejected from the ejection ports 2 or the like. Moreover, the deviation amount and deviation cycle of the liquid delivery mechanism 12 may be varied according to the required rate of the circulation flow of the ink.

Consequently, like in the first embodiment, no ink resides near the ejection ports 2 even during non-print operation, thus curbing the adverse influence of the deterioration of the ink near the ejection ports 2 (the deterioration caused by the evaporation of volatile components contained in the ink) on the ejection quantity and landing accuracy of the ink. The circulation channel of the ink can be efficiently formed even in a print head having numerous ejection ports. Since the first droplet of the ink is ejected from the ejection ports, the ejection status of the ink can be stabilized by suppressing the deterioration of the ink by the effect of the above-described circulation channel.

Additionally, in the present embodiment, only one supply path 8 is provided as a supply path. Therefore, the number of supply paths can be reduced in comparison with the configuration requiring the supply paths 8A and 8B as supply paths, unlike the first embodiment. The resultant vacant space is greater than space required for disposing the liquid delivery mechanism 12, thus further increasing the array density of the ejection ports 2 so as to achieve the greater miniaturization of the substrate 4.

Third Embodiment

The basic configuration of a print head 100 in the present embodiment is identical to that in the first embodiment, and therefore, the characteristic configuration of the present embodiment will be described below.

Figure 6A:
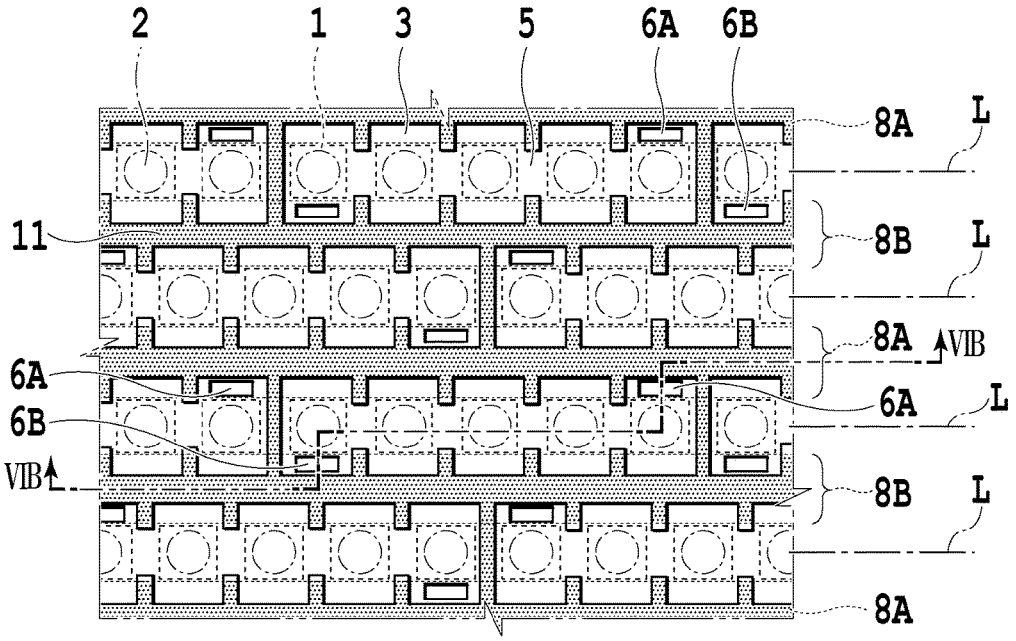
FIG. 6A is a diagram illustrating a substrate in a print head in a third embodiment of the present invention.
Figure 6B:
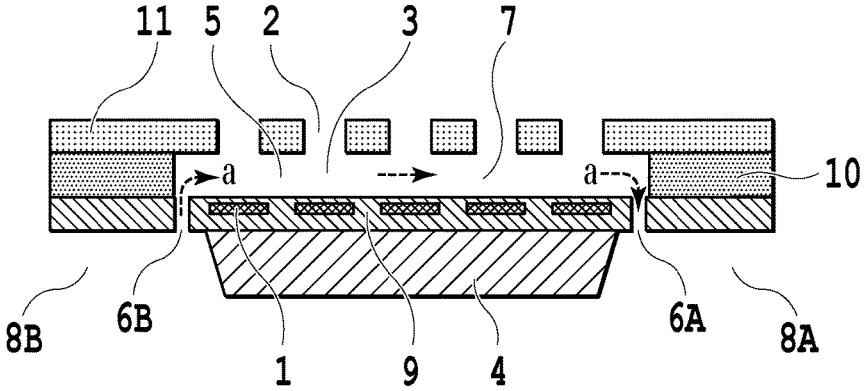
FIG. 6B is a cross-sectional view taken along a line VIB-VIB of FIG. 6A.

FIG. 6A is a schematic diagram illustrating a substrate 4 in the present embodiment; and FIG. 6B is a cross-sectional view taken along a line VIB-VIB of FIG. 6A. Connection ports 6A and 6B in the present embodiment penetrate a functional layer 9 serving as a part of the substrate 4. The connection port 6A is formed as a penetration recovery path whereas the connection port 6B is formed as a penetration supply path. These connection ports 6A and 6B are connected to supply paths 8A and 8B formed on the substrate 4 in such a manner as to be positioned under a circulation channel 7 and the functional layer 9, as illustrated in FIG. 6B. In the above-described first and second embodiments, the circulation channel 7 and the supply paths 8A and 8B are formed at the same surface (at a first surface) of the substrate 4. Moreover, the supply paths 8A and 8B are formed on the substrate 4, and the circulation channel 7 is connected to an ink tank via the penetration recovery path and the penetration supply path that penetrate the substrate 4. In the present embodiment, the circulation channel 7 is positioned at the first surface side of the substrate 4; the connection ports 6A and 6B serve as the penetration supply path and the penetration recovery path; and the supply paths 8A and 8B are positioned at a second surface side of the substrate 4. The connection ports 6A and 6B have a cross-sectional area of 100 $\mu m^2$ (=5 μm×20 μm) and a length of 20 μm. The circulation channel 7 has a height of 20 μm. The supply paths 8A and 8B have a width of 50 μm. An ejection port forming member 11 has a thickness of 15 μm.

The supply paths 8A and 8B are formed on the substrate 4 in such a manner as to extend along an ejection port array L. To the supply path 8B is connected a first supply source, not shown, for supplying ink having a pressure P1. To the supply path 8A is connected a second supply source, not shown, for supplying ink having a pressure P2 lower than the pressure P1. As a consequence, an ink flow in a direction indicated by an arrow "a" in FIG. 6B from the connection port 6B to the connection port 6A is caused in the circulation channel 7 by the difference (P1−P2) in pressure. In the present embodiment, the difference (P1−P2) in pressure is 250 mmAq. The ink flow (the circulation flow) caused by the difference in pressure is produced in the plurality of pressure chambers 3 formed in the circulation channel 7, thus supplying fresh ink near the ejection ports 2 in each of the pressure chambers 3 all the time. In other words, the ink reserved or stored in an ink tank, not shown, is supplied from the supply path 8B to the circulation channel 7 through the connection port 6B, and then, is returned to the ink tank through the plurality of pressure chambers 3 formed in the circulation channel 7, the connection port 6A, and the supply path 8A.

Consequently, like in the first embodiment, no ink resides near the ejection ports 2 even during non-print operation, thus curbing the adverse influence of the deterioration of the ink near the ejection ports 2 (the deterioration caused by the evaporation of volatile components contained in the ink) on the ejection quantity and landing accuracy of the ink. The circulation channel of the ink can be efficiently formed even in a print head having numerous ejection ports. Since the first droplet of the ink is ejected from the ejection ports, the ejection status of the ink can be stabilized by suppressing the deterioration of the ink by the effect of the above-described circulation channel.

Additionally, the supply paths 8A and 8B in the constitutional example illustrated in FIG. 6A are formed in such a manner as to be shared by adjacent ejection port arrays L, and therefore, the same ink is supplied to all of the ejection port arrays L. However, the supply paths 8A and 8B may be independently disposed with respect to the ejection port arrays L, thus ejecting different types of ink from the ejection port arrays L. The supply paths 8A and 8B are disposed at one surface of the substrate 4 (a lower surface in FIG. 6B) opposite to the other surface of the substrate 4, at which the pressure chambers 3 are formed (an upper surface in FIG. 6B), thus increasing the array density of the ejection ports 2 so as to achieve the miniaturization of the substrate 4. Furthermore, it is possible to shorten the circulation channel 7 so as to enhance the efficiency of the ink circulation.

Fourth Embodiment

The basic configuration of a print head 100 in the present embodiment is identical to that in the third embodiment, and therefore, the characteristic configuration of the present embodiment will be described below.

Figure 7A:
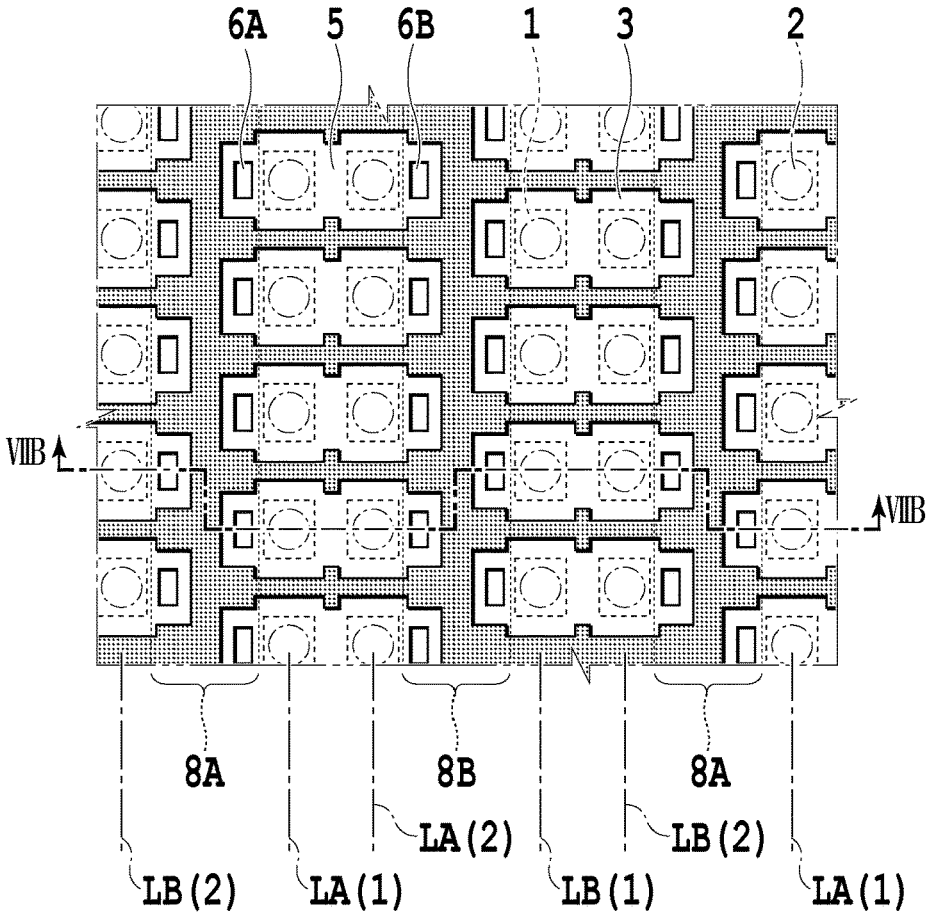
FIG. 7A is a diagram illustrating a substrate in a print head in a fourth embodiment of the present invention.
Figure 7B:
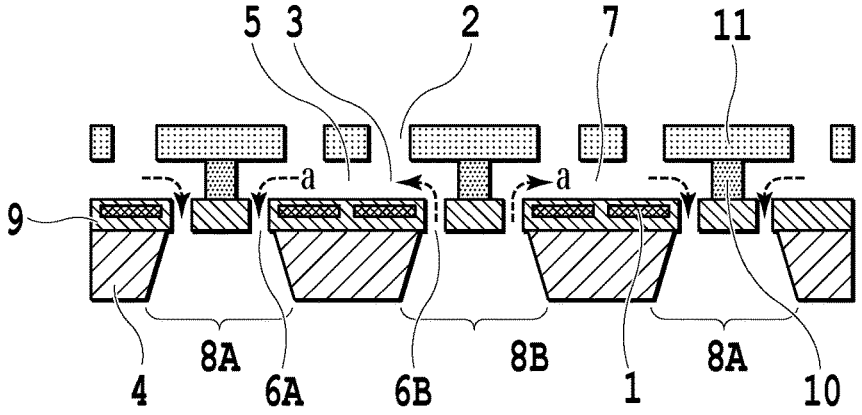
FIG. 7B is a cross-sectional view taken along a line VIIB-VIIB of FIG. 7A.

FIG. 7A is a schematic diagram illustrating a substrate 4 in the present embodiment; and FIG. 7B is a cross-sectional view taken along a line of FIG. 7A. Ejection port arrays in the present embodiment include ejection port arrays LA(1) and LA(2) whose pitches of ejection ports 2 are not shifted and ejection port arrays LB(1) and LB(2) whose pitches of the ejection ports 2 are not shifted. The ejection ports 2 at the ejection port arrays LA(1) and LA(2) and the ejection ports 2 at the ejection port arrays LB(1) and LB(2) are shifted by a half pitch in an array direction. There are provided a plurality of groups, each consisting of the ejection port arrays LA(1) and LA(2), and a plurality of groups, each consisting of the ejection port arrays LB(1) and LB(2). A circulation channel 7 is formed in such a manner as to connect two adjacent pressure chambers 3 horizontally in FIG. 7A in the ejection port arrays LA(1) and LA(2) and to connect two adjacent pressure chambers 3 horizontally in FIG. 7A in the ejection port arrays LB(1) and LB(2). Like in the third embodiment, the circulation channel 7 and supply paths 8A and 8B are connected to each other via connection ports 6A and 6B serving as a penetration recovery path and a penetration supply path, respectively, that penetrate a functional layer 9 serving as a part of the substrate 4. In the present embodiment, pressure chambers corresponding to the ejection ports formed at the different ejection port arrays are connected in series in a single circulation channel.

In the present embodiment, the area of a heater 1 is 500 $\mu m^2$ (=20 μm×25 μm); the diameter of the ejection port 2 is 20 μm; the cross-sectional area of the pressure chamber 3 is 750 $\mu m^2$ (=25 μm×30 μm); the width of a connection channel 5 is 25 μm; and the length of the connection channel 5 is 7 μm. Additionally, each of the connection ports 6A and 6B has a cross-sectional area of 100 $\mu m^2$ (=5 μm×20 μm) and a length of 20 μm. The circulation channel 7 has a height of 15 μm. Each of the supply paths 8A and 8B has a width of 40 μm. The ejection port forming member 11 has a thickness of 12 μm. The viscosity of the ink is 3 cP. The ink ejection quantity is 7 pL.

The supply paths 8A and 8B are formed on the substrate 4 in such a manner as to extend along an ejection port array L(LA(1), LB(1), LA(2), and LB(2)). To the supply path 8B is connected a first supply source, not shown, for supplying ink having a pressure P1. To the supply path 8A is connected a second supply source, not shown, for supplying ink having a pressure P2 smaller than the pressure P1. As a consequence, the ink flow in a direction indicated by an arrow "a" in FIG. 7B from the connection port 6B to the connection port 6A is caused in the circulation channel 7 by the difference (P1−P2) in pressure. The ink flow (the circulation flow) caused by the difference in pressure is produced in the plurality of pressure chambers 3 formed in the circulation channel 7, thus supplying fresh ink near the ejection ports 2 in each of the pressure chambers 3 all the time. In other words, the ink reserved in an ink tank, not shown, is supplied from the supply path 8B to the circulation channel 7 through the connection port 6B, and then, is returned to the ink tank through the plurality of pressure chambers 3 formed in the circulation channel 7, the connection port 6A, and the supply path 8A.

Consequently, like in the first embodiment, no ink resides near the ejection ports 2 even during non-print operation, thus curbing the adverse influence of the deterioration of the ink near the ejection ports 2 (the deterioration caused by the evaporation of volatile components contained in the ink) on the ejection quantity and landing accuracy of the ink. The circulation channel of the ink can be efficiently formed even in a print head having numerous ejection ports. Since the first droplet of the ink is ejected from the ejection ports, the ejection status of the ink can be stabilized by suppressing the deterioration of the ink by the effect of the above-described circulation channel.

Additionally, the supply paths 8A and 8B in the constitutional example illustrated in FIG. 7A and FIG. 7B are formed in such a manner as to be shared by the adjacent ejection port arrays LA(1) and LB(2) and the adjacent ejection port arrays LA(2) and LB(1), respectively, and therefore, the same ink is supplied to all of the ejection port arrays. However, the supply paths 8A and 8B may be independently disposed with respect to the adjacent ejection port arrays, thus ejecting different types of ink from the ejection port arrays. Like in the third embodiment, the supply paths 8A and 8B are disposed at a surface of the substrate 4 opposite to a surface of the substrate 4 at which the pressure chambers 3 are formed, thus enhancing the array density of the ejection ports 2 so as to achieve the miniaturization of the substrate 4. Furthermore, it is possible to shorten the circulation channel 7 so as to enhance the efficiency of the ink circulation.

Fifth Embodiment

The basic configuration of a print head 100 in the present embodiment is identical to that in the fourth embodiment, and therefore, the characteristic configuration of the present embodiment will be described below.

Figure 8A:
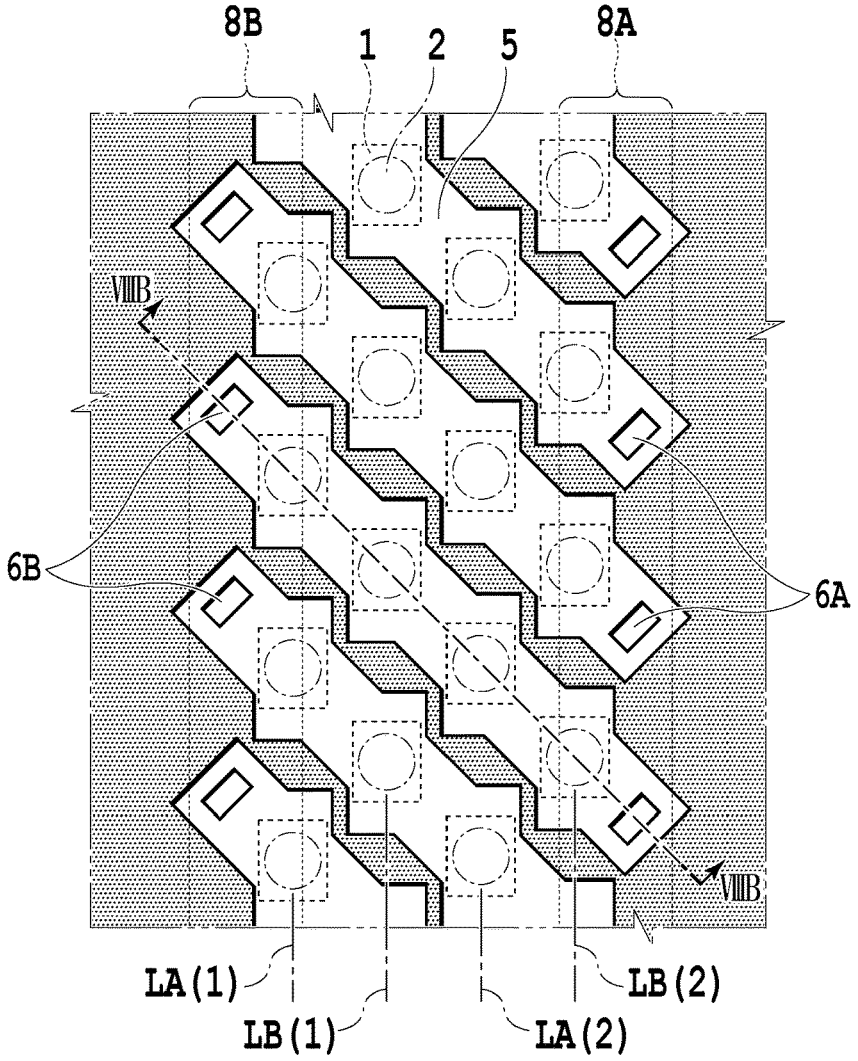
FIG. 8A is a diagram illustrating a substrate in a print head in a fifth embodiment of the present invention.
Figure 8B:
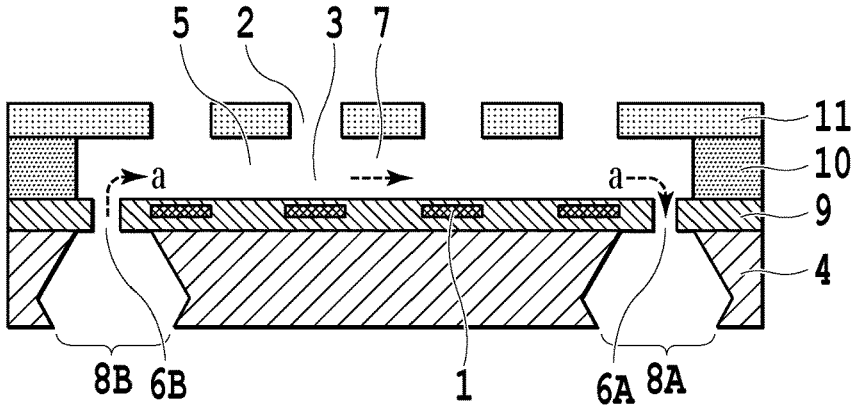
FIG. 8B is a cross-sectional view taken along a line VIIIB-VIIIB of FIG. 8A.

FIG. 8A is a schematic diagram illustrating the essential parts of a substrate 4 in the present embodiment; and FIG. 8B is a cross-sectional view taken along a line of FIG. 8A. In the present embodiment, the ejection port arrays LA(1), LB(1), LA(2), and LB(2) in the above-described fourth embodiment are formed adjacent to each other. A circulation channel 7 is formed in such a manner as to connect four adjacent pressure chambers 3 in the ejection port arrays. To a supply path 8B is connected a first supply source, not shown, for supplying ink having a pressure P1. To a supply path 8A is connected a second supply source, not shown, for supplying ink having a pressure P2 lower than the pressure P1. As a consequence, an ink flow in a direction indicated by an arrow "a" in FIG. 8B from a connection port 6B to a connection port 6A is caused in the circulation channel 7 by the pressure difference (P1-P2). The ink flow (a circulation flow) is caused in a plurality of pressure chambers 3 by the difference in pressure formed in the circulation channel 7, thus supplying fresh ink near ejection ports 2 in each of the pressure chambers 3 all the time.

Consequently, like in the first embodiment, no ink resides near the ejection ports 2 even during non-print operation, thus curbing the adverse influence of the deterioration of the ink near the ejection ports 2 (the deterioration caused by the evaporation of volatile components contained in the ink) on the ejection quantity and landing accuracy of the ink.

<First Modification>

Figure 9A:
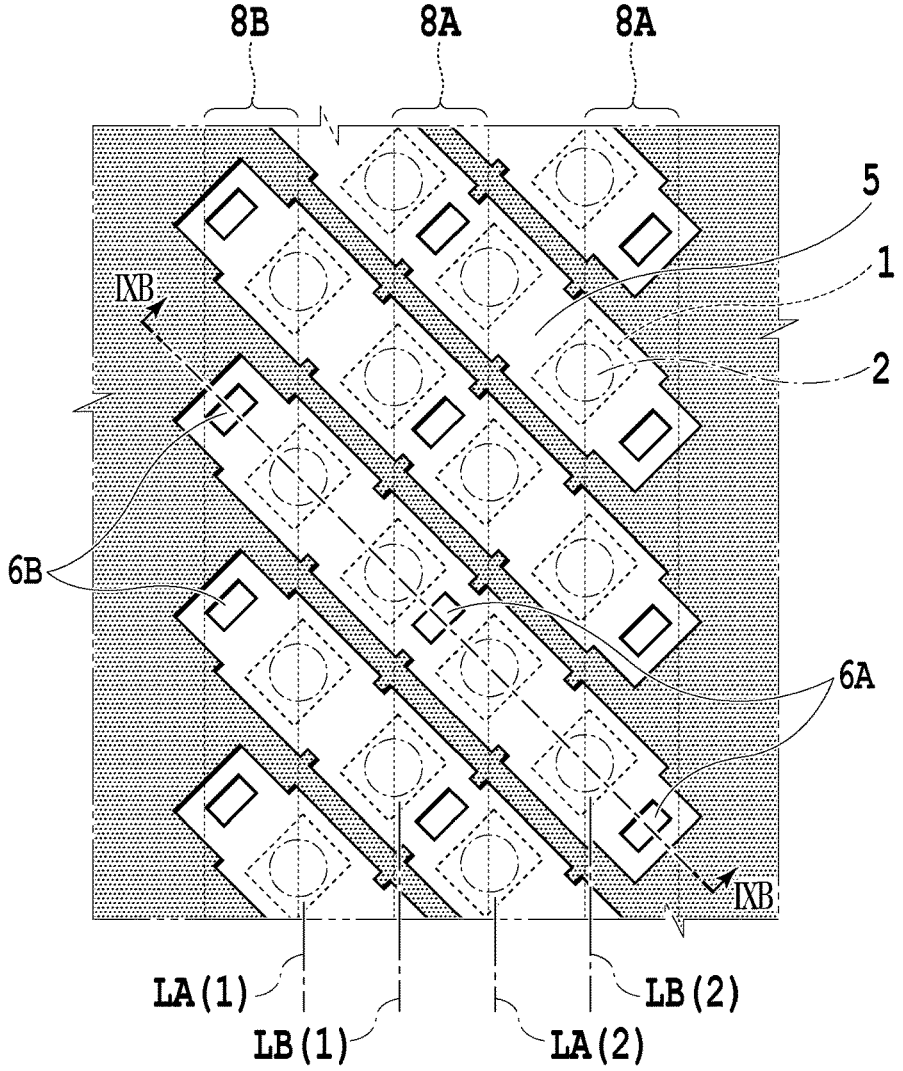
FIG. 9A is a diagram illustrating a first modification of the substrate illustrated in FIG. 8A.
Figure 9B:
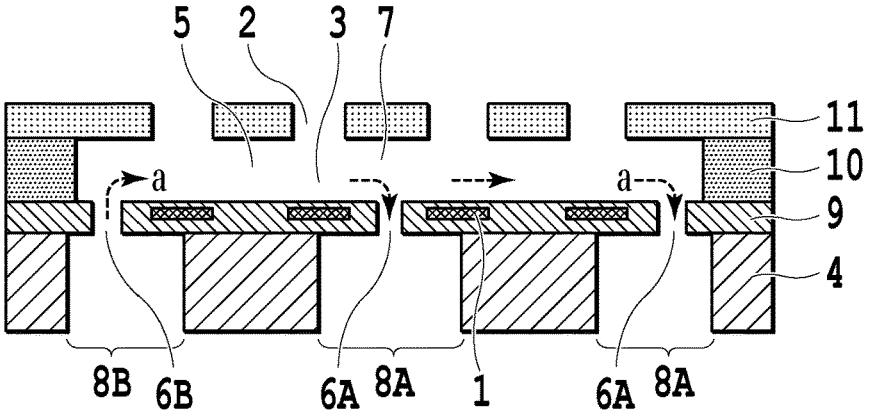
FIG. 9B is a cross-sectional view taken along a line IXB-IXB of FIG. 9A.

FIG. 9A is a schematic diagram illustrating the essential parts of a substrate 4 in a first modification of the present embodiment; and FIG. 9B is a cross-sectional view taken along a line IXB-IXB of FIG. 9A.

In the present modification, a single circulation channel 7 includes one connection port 6B, one supply path 8B, two connection ports 6A, and two supply paths 8A. The single circulation channel 7 includes the connection ports (penetration recovery paths) 6A and the connection port (a penetration supply path) 6B in the total number of three. In this manner, the circulation channel 7 is refilled with ink through the three connection ports 6A and 6B in total after ink ejection. As a consequence, an ink refilling time can be shortened. The number of connection ports 6A and 6B formed and the ratio of the formation are not limited, and therefore, they can be arbitrarily determined. The supply path 8A does not need to be formed in a manner corresponding to the single connection port 6A in the single circulation channel 7, like in the present modification. For example, the supply path 8A may be formed in a manner corresponding to a plurality of connection ports 6A in the single circulation channel 7. In the same manner, the supply path 8B does not need to be formed in a manner corresponding to the single connection port 6B in the single circulation channel 7, like in the present modification. For example, the supply path 8B may be formed in a manner corresponding to a plurality of connection ports 6B in the single circulation channel 7.

<Second Modification>

Figure 10:
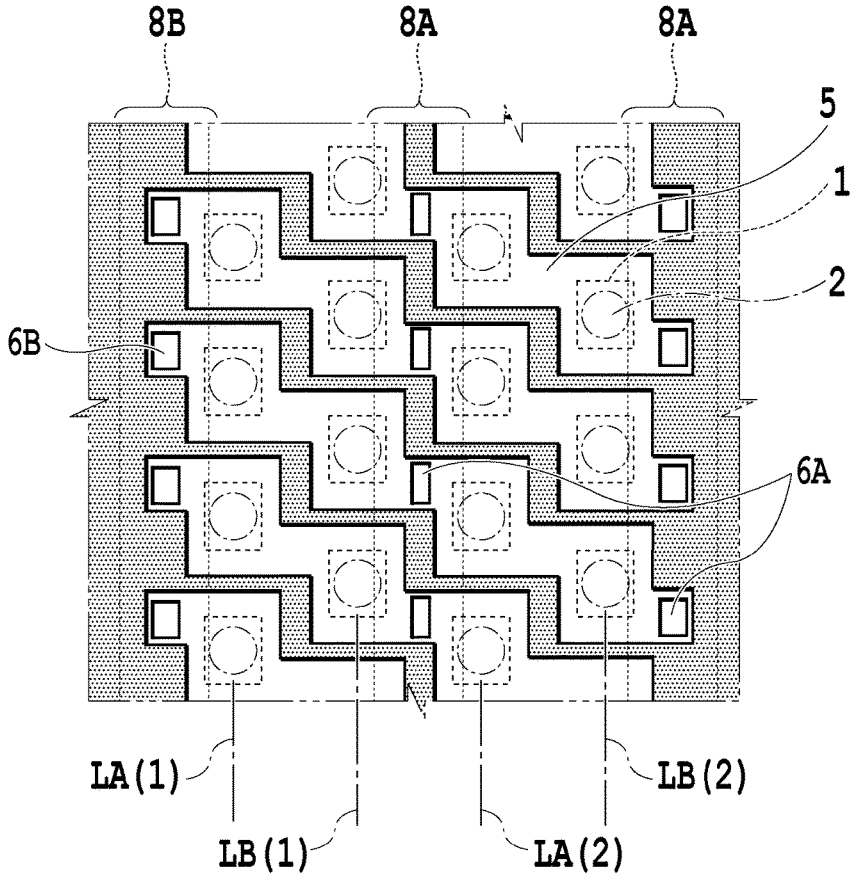
FIG. 10 is a diagram illustrating a second modification of the substrate illustrated in FIG. 8A.

FIG. 10 is a schematic diagram illustrating the essential parts of a substrate 4 in a second modification of the present embodiment.

In the present modification, a circulation channel 7 connecting a plurality of pressure chambers 3 is formed in a zigzag fashion, unlike a linear fashion illustrated in FIG. 9A. The shape of the circulation channel 7 may be arbitrarily determined as long as the circulation channel 7 can connect to the plurality of pressure chambers 3. The layout and number of pressure chambers 3 to be formed, the shape of a connection channel 5, the position and number of connection ports (penetration recovery paths) 6A and connection ports (penetration supply paths) 6B to be formed are not particularly limited, and therefore, they may be arbitrarily determined. Their optimization can suppress crosstalk among the pressure chambers 3, speed up the refilling of ink, and achieve an optimum ink circulation flow.

Sixth Embodiment

The basic configuration of a print head 100 in the present embodiment is identical to that in the fourth embodiment, and therefore, the characteristic configuration of the present embodiment will be described below.

Figure 11A:
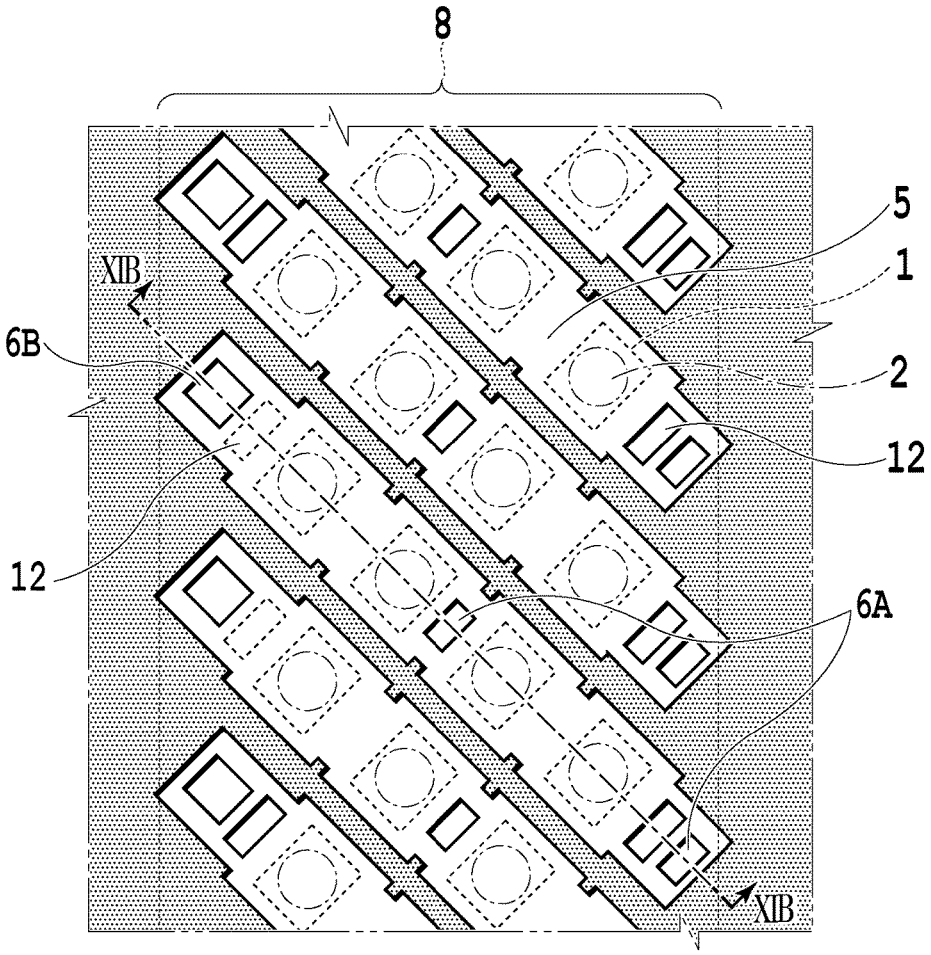
FIG. 11A is a diagram illustrating a substrate in a print head in a sixth embodiment of the present invention.
Figure 11B:
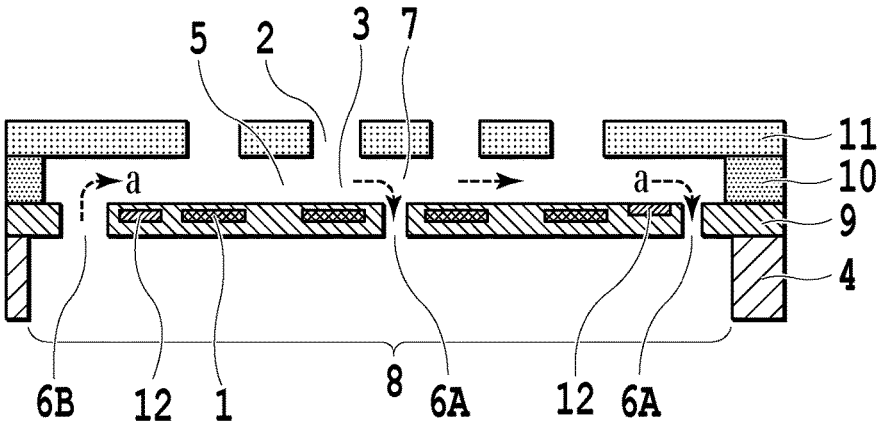
FIG. 11B is a cross-sectional view taken along a line XIB-XIB of FIG. 11A.

FIG. 11A is a schematic diagram illustrating the essential parts of a substrate 4 in the present embodiment; and FIG. 11B is a cross-sectional view taken along a line XIB-XIB of FIG. 11A. In the present embodiment, liquid delivery mechanisms 12 for ink are provided at both ends of a circulation channel 7. The area of a heater 1 is 396 $\mu m^2$ (=18 μm×22 μm); the diameter of an ejection port 2 is 18 μm; the cross-sectional area of a pressure chamber 3 is 750 $\mu m^2$ (=25 μm×30 μm); the width of a connection channel 5 is 18 μm; and the length of the connection channel 5 is 7 μm. Additionally, the cross-sectional area of a connection port (a penetration recovery path) 6A is 75 $\mu m^2$ (=5 μm×15 μm) whereas the cross-sectional area of a connection port 6B (a penetration supply path) is 150 $\mu m^2$ (=10 μm×15 μm). The length of each of the connection ports 6A and 6B is 20 μm.

The height of the circulation channel 7 is 12 μm. The width of a supply path 8 is 250 μm. The thickness of an ejection port forming member 11 is 10 μm. The viscosity of ink is 3 cP. An ink ejection quantity is 4 pL.

In the present embodiment, the two liquid delivery mechanisms 12 on the single circulation channel 7 feed fresh ink from the supply path 8 to the connection port 6B, thus producing a circulation flow of the ink in the circulation channel 7 in a direction indicated by an arrow "a" in FIG. 11B. In order to achieve an asymmetric channel resistance of the circulation channel 7, the opening area (the cross-sectional area) of the connection port 6B is greater than that of the connection port 6A. The asymmetry of the channel resistance produces the circulation flow of the ink in the direction indicated by the arrow "a" when the two liquid delivery mechanisms 12 are driven. During ink refilling or the like, the ink staying in the supply path 8 may be fed into the connection port 6A. Like in the second embodiment, the liquid delivery mechanism 12 is simply required to supply the ink into the circulation channel 7 from the supply path 8, and therefore, its configuration is not limited. For example, apparatus capable of delivering ink such as a resistance type heater, a piezoelectric actuator, an electrostatic actuator, and a mechanical/impact drive type actuator may be used. The liquid delivery mechanism 12 in the present embodiment supplies the ink by the use of a piezoelectric actuator that changes the inner volume of the circulation channel 7.

<First Modification>

Figure 12A:
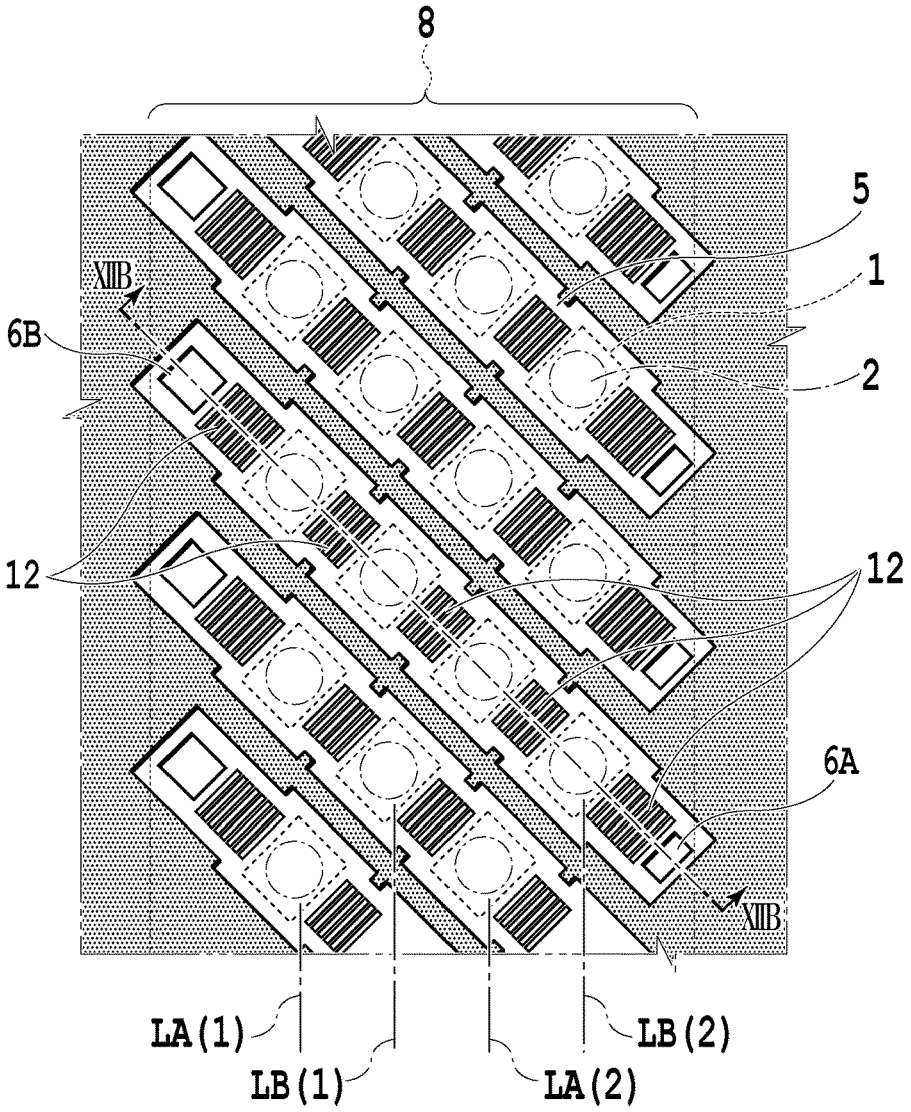
FIG. 12A is a diagram illustrating a first modification of the substrate illustrated in FIG. 11A.
Figure 12B:
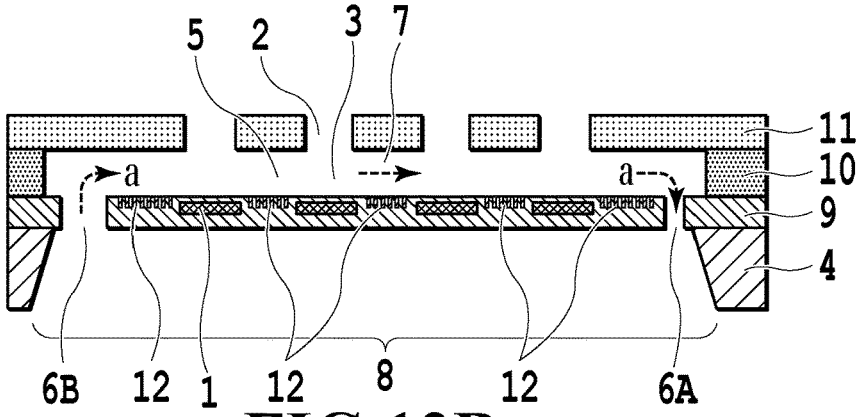
FIG. 12B is a cross-sectional view taken along a line XIIB-XIIB of FIG. 12A.

FIG. 12A is a schematic diagram illustrating the essential parts of a substrate 4 in a first modification of the present embodiment; and FIG. 12B is a cross-sectional view taken along a line XIIB-XIIB of FIG. 12A.

In the present modification, each of liquid delivery mechanisms 12 is formed of a toothcomb-like electrode. The liquid delivery mechanisms 12 are disposed at both ends of a circulation channel 7 and between pressure chambers 3. An alternating current is applied to between the toothcomb-like electrodes of the liquid delivery mechanisms 12, thus producing electroosmosis in ink. The electroosmosis produces the circulation flow of ink inside of the circulation channel 7 in a direction indicated by an arrow "a" illustrated in FIG. 12B.

<Second Modification>

Figure 13:
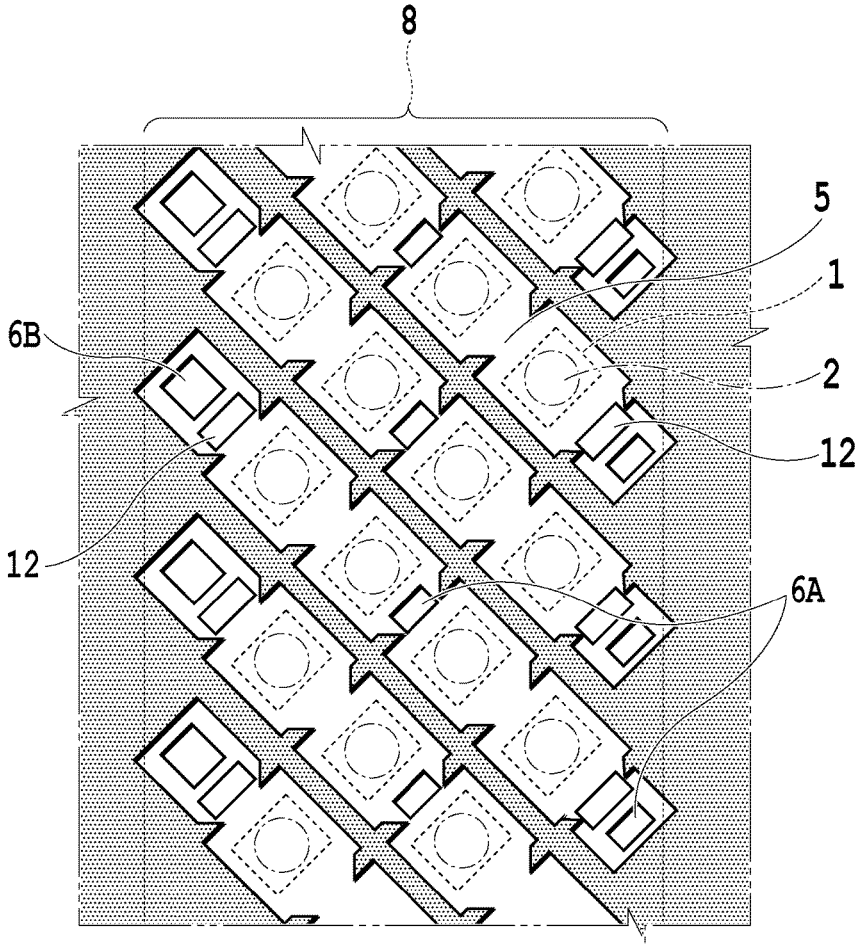
FIG. 13 is a diagram illustrating a second modification of the substrate illustrated in FIGS. 11A and 11B.

FIG. 13 is a schematic diagram illustrating the essential parts of a substrate 4 in a second modification of the present embodiment.

A connection channel 5 in the present modification is different in shape from the above-described connection channel 5 illustrated in FIG. 11A and FIG. 11B. The cross section of a channel is gradually reduced in such a manner as to be tapered from a connection port 6B toward a connection port 6A. In this manner, channel resistance from the connection port 6B toward the connection port 6A in one direction becomes smaller than that from the connection port 6A toward the connection port 6B in the other direction, thus making the channel resistance asymmetric. This connection channel 5 fulfills the function of suppressing crosstalk among pressure chambers 3 and assisting the production of the circulation flow of ink.

The configuration of the circulation channel 7 provided with the pressure chambers 3, the connection ports 6A and 6B, the connection channel 5, and liquid delivery mechanisms 12 is not limited to that in the present modification. The configuration of the circulation channel 7 can be optimized so as to suppress crosstalk among the pressure chambers 3, speed up ink refilling, and achieve the optimum circulation flow of ink.

Seventh Embodiment

The basic configuration of a print head 100 in the present embodiment is identical to that in the third embodiment, and therefore, the characteristic configuration of the present embodiment will be described below.

Figure 14A:
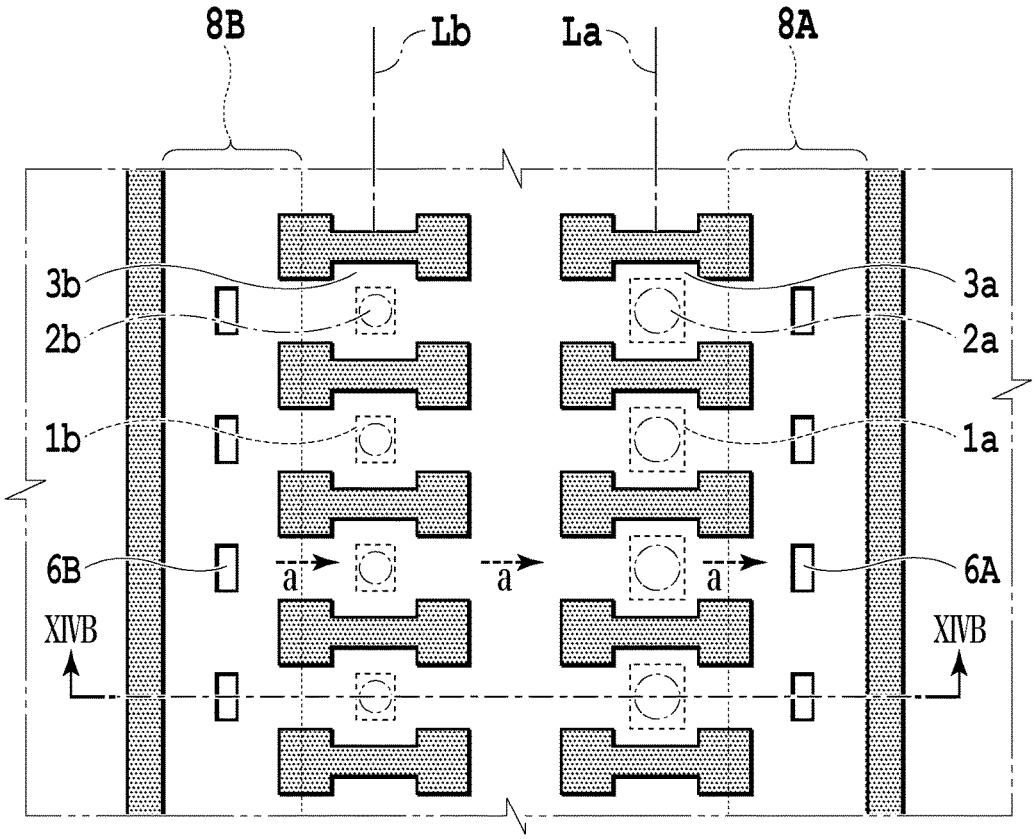
FIG. 14A is a diagram illustrating a substrate in a print head in a seventh embodiment of the present invention.
Figure 14B:
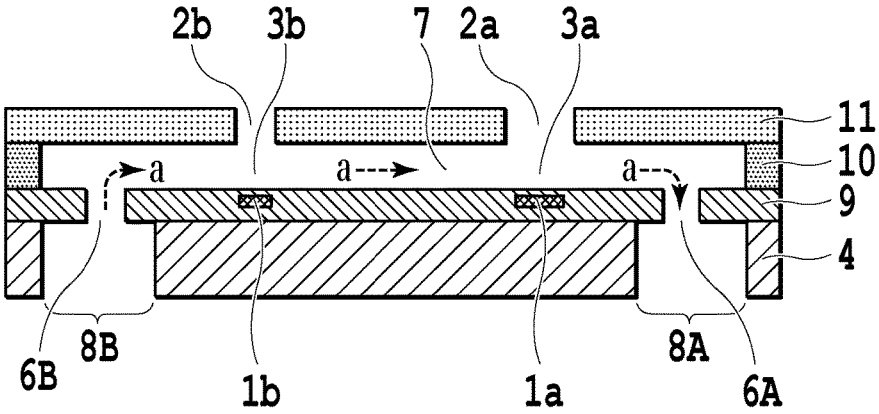
FIG. 14B is a cross-sectional view taken along a line XIVB-XIVB of FIG. 14A.

FIG. 14A is a schematic diagram illustrating the essential parts of a substrate 4 in the present embodiment; and FIG. 14B is a cross-sectional view taken along a line XIVB-XIVB of FIG. 14A. In the present embodiment, a plurality of ejection ports 2*a* and 2*b* are arrayed at each of two ejection port arrays La and Lb in a pitch corresponding to a resolution of 600 dpi. The print width of the print head 100 is 20 mm. Heaters 1*a* and 1*b* serving as ejection energy generating elements are provided in pressure chambers 3*a* and 3*b* corresponding to the ejection ports 2 (2*a* and 2*b*) at the ejection port arrays La and Lb. The pressure chambers 3*a* and 3*b* are connected to supply paths 8A and 8B via a connection port (a penetration recovery path) 6A and a connection port (a penetration supply path) 6B, thus forming a circulation channel 7 in the planar direction of the substrate 4. The pressure chamber 3 is defined by a channel forming member 10. Ejection ports 2*a* and 2*b* are formed at an ejection port forming member 11. A member (e.g., a columnar structure) forming a filter for preventing the intrusion of foreign matter such as air bubbles into the pressure chambers 3*a* and 3*b* may be interposed between the supply paths 8A and 8B and the connection ports 6A and 6B.

The pressure chamber 3*b* at the ejection port array Lb is connected to the supply path 8B via the connection port 6B whereas the pressure chamber 3*a* at the ejection port array La is connected to the supply path 8A via the connection port 6A. The pressure of ink supplied to the supply path 8B by a pump disposed outside of the print head 100 is set to be higher than that of ink supplied to the supply path 8A. The difference in pressure causes the flow (the circulation flow) of the ink in a direction indicated by an arrow "a" toward the supply path 8A from the supply path 8B through the circulation channel 7. The number of pressure chambers formed in the circulation channel 7 is not limited to two, unlike in the present embodiment, and therefore, it is simply required to be two or more. In addition, the layout of the ejection ports 2*a* and 2*b* formed in the circulation channel 7 is not limited to a layout in which they are arrayed on a line perpendicular to the ejection port arrays La and Lb, unlike the present embodiment, and therefore, it may be arbitrarily determined. Moreover, the circulation flow of the ink may be branched or converged between the ejection ports 2*a* and 2*b*.

In the present embodiment, the area of the heater 1*a* is 750 $\mu m^2$ (=25 μm×30 μm); the area of the heater 1*b* is 240 $\mu m^2$ (=12 μm×20 μm); the diameter of the ejection port 2*a* is 25 μm; and the diameter of the ejection port 2*b* is 12 μm. Furthermore, the cross-sectional area of each of the pressure chambers 3*a* and 3*b* is 1050 $\mu m^2$ (=30 μm×35 μm); the width of each of the connection ports 6A and 6B is 20 μm; the length of each of the connection ports 6A and 6B is 20 μm; the height of the circulation channel 7 is 20 μm; and the width of each of the supply paths 8A and 8B is 50 μm. Additionally, the thickness of the ejection port forming member 11 is 20 μm; the viscosity of the ink is 5 cP; the ink ejection quantity from the ejection port 2*a* is 10 pL; and the ink ejection quantity from the ejection port 2*b* is 5 pL.

The ink stored in an ink tank, not shown, is supplied from the supply path 8B to the circulation channel 7 through the connection port 6B, and then, is returned to the ink tank through the pressure chambers 3*a* and 3*b* formed in the circulation channel 7, the connection port 6A, and the supply path 8A. The heaters 1*a* and 1*b* serving as ejection energy generating elements are electrically connected to the electric wiring substrate 102 illustrated in FIG. 1 via electric wires and terminals formed on the substrate 4.

The heaters 1*a* and 1*b* are driven to generate heat in response to a pulse signal input by a print control circuit, not shown. The heat generated by the heaters 1*a* and 1*b* produces bubbles in the ink staying inside of the pressure chambers 3*a* and 3*b*, and furthermore, the resultant bubble energy ejects the ink from the ejection ports 2*a* and 2*b*. The pressure chambers 3*a* and 3*b* are spaces defined by the channel forming member 10 and the ejection port forming member 11. For example, four ejection port arrays are arranged, and then, the ink of the same color is supplied to pressure chambers formed at the four ejection port arrays, thus enabling an image to be printed in a single color. The ejection port arrays may be formed on the single substrate 4 or may be formed on a plurality of substrates 4 arranged.

(Control of Circulation Flow of Ink)

To the supply path 8B is connected a first supply source, not shown, for supplying the ink having a pressure P1. To the supply path 8A is connected a second supply source, not shown, for supplying the ink having a pressure P2 smaller than the pressure P1. As a consequence, an ink flow in a direction indicated by an arrow "a" in FIG. 14B from the connection port 6B to the connection port 6A is caused in the circulation channel 7 by the difference (P1−P2) in pressure. In the present embodiment, the difference (P1−P2) in pressure is 100 mmAq. The ink flow (the circulation flow) caused by the difference in pressure is produced in the plurality of pressure chambers 3 formed in the circulation channel 7, thus supplying fresh ink near the ejection ports 2*a* and 2*b* in the pressure chambers 3*a* and 3*b* all the time. The first and second supply sources may be configured by using, for example, a vacuum pump, a pressure adjustor, and an air chamber in combination and the height difference of the ink. Moreover, a liquid delivery mechanism (such as a heater or piezoelectric element for delivering liquid) for ink may be provided in the circulation channel 7 as a drive source for circulating the ink.

In this manner, the ink flow in the circulation channel 7 is caused by the difference (P1−P2) in pressure even during non-print operation in which no ink is ejected from the ejection ports 2*a* and 2*b*, thus supplying fresh ink near the pressure chambers 3*a* and 3*b* and the ejection ports 2*a* and 2*b*.

Figure 15A:
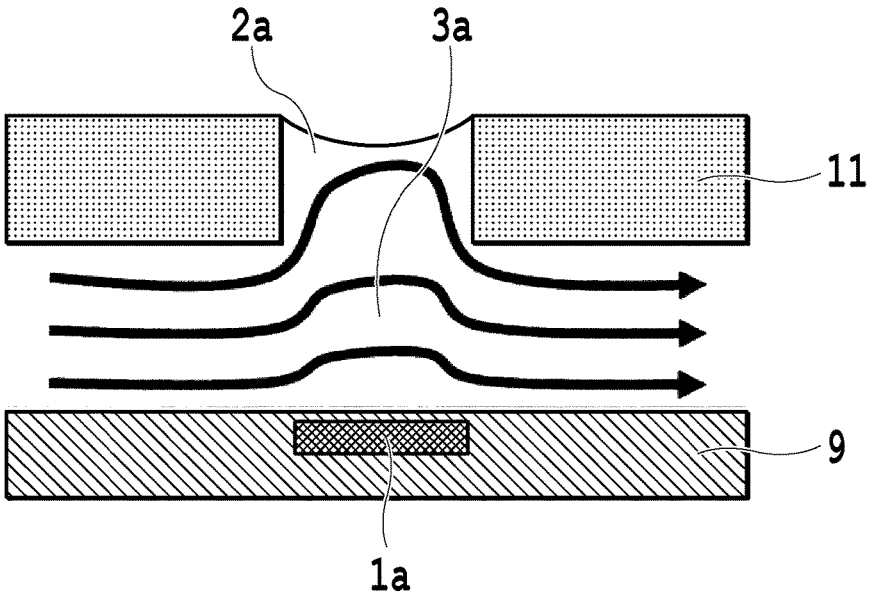
FIGS. 15A and 15B are diagrams illustrating an ink flow on the substrate illustrated in FIG. 14A.
Figure 15B:
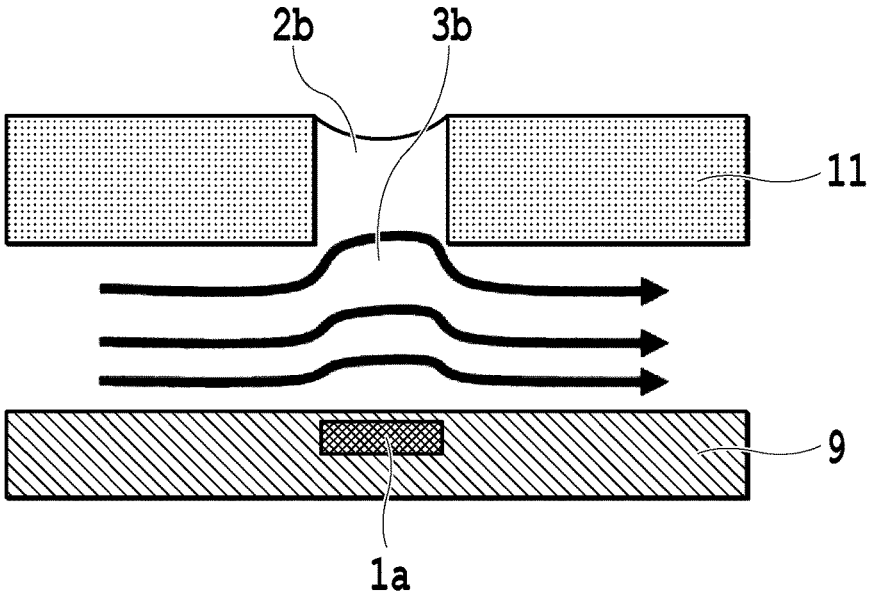

FIG. 15A and FIG. 15B are diagrams illustrating an ink flow near the ejection ports 2*a* and 2*b*. As illustrated in FIG. 15A, the circulation flow of the ink intrudes into the ejection port 2*a* having a relatively greater cross section, thereby easily replacing the ink. Consequently, the ink hardly resides in the ejection port 2*a*, thus maintaining the ejection stability of the ink from the ejection port 2*a*. In contrast, as illustrated in FIG. 15B, the circulation flow of the ink hardly intrudes into the ejection port 2*b* having a relatively smaller cross section, thereby hardly replacing the ink. However, since the fresh ink is supplied to the ejection port 2*b* formed upstream of the circulation channel 7 through the connection port 6B all the time, high ejection stability is achieved even at the ejection port 2*b* into which the circulation flow of the ink hardly intrudes. Furthermore, there is a risk of the intrusion of the ink having a high concentration (viscous ink), whose volatile components are evaporated through the vicinity of the ejection port 2*b*, into the ejection port 2*a* formed downstream of the circulation channel 7 beyond the ejection port 2*b*. However, as described above, since the ink is easily replaced in the ejection port 2*a*, the ejection stability is hardly susceptible to the intrusion of the ink having a high concentration (viscous ink), thus maintaining the ejection stability of the ink from the ejection ports 2*a*.

In this manner, the vertical flow of the ink in the direction indicated by the arrow "a" is produced during non-print operation during which no ink is ejected from the ejection ports 2*a* and 2*b*, so that the ink can be replaced near the pressure chambers 3*a* and 3*b* and the ejection ports 2*a* and 2*b*. As a consequence, even during non-print operation, no ink resides near the ejection ports 2*a* and 2*b*, thus curbing the adverse influence of the deterioration of the ink near the ejection ports 2*a* and 2*b* (the deterioration caused by the evaporation of volatile components contained in the ink) on the ejection quantity and landing accuracy of the ink.

Since the circulation flow of the ink for suppressing the deterioration of the ink is produced in the circulation channel connecting the plurality of pressure chambers to each other, the space required for forming the circulation channel can be reduced without any increase in proportion to the number of ejection ports. The circulation channel of the ink can be efficiently formed even in a print head having numerous ejection ports. Since the first droplet of the ink is ejected from the ejection ports, the ejection status of the ink can be stabilized by suppressing the deterioration of the ink by the effect of the above-described circulation channel. Furthermore, the variations of landing positions of the ink can be reduced. Additionally, it is possible to array the ejection ports in a high density while efficiently forming the circulation channel for the ink so as to achieve the miniaturization of the substrate.

Eighth Embodiment

The basic configuration of a print head 100 in the present embodiment is identical to that in the seventh embodiment, and therefore, the characteristic configuration of the present embodiment will be described below.

Figure 16:
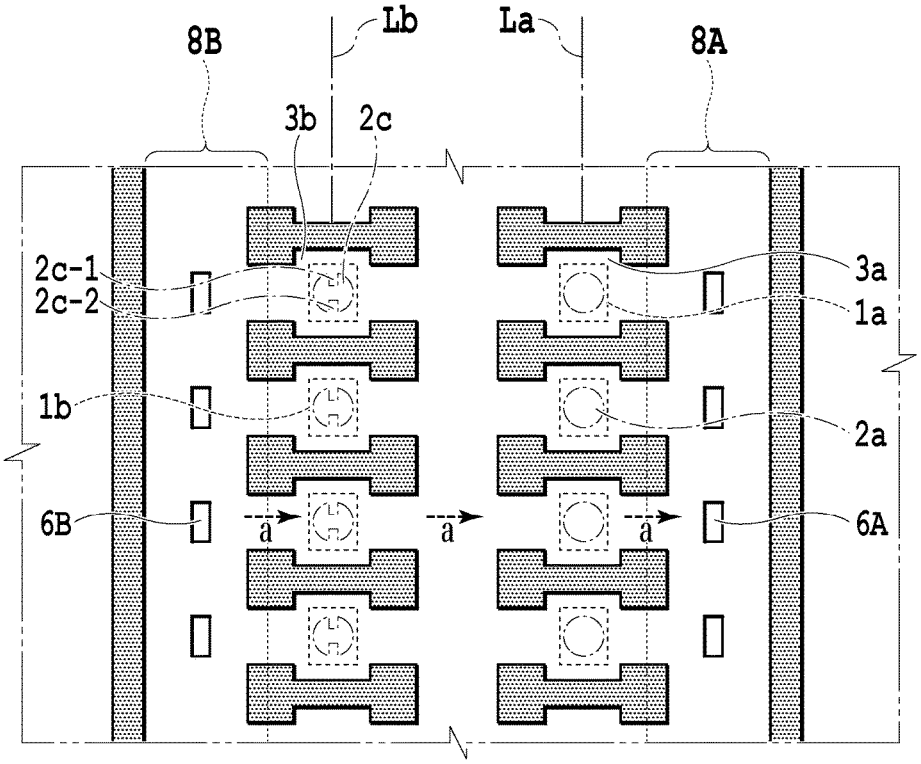
FIG. 16 is a diagram illustrating a substrate in a print head in an eighth embodiment of the present invention.

FIG. 16 is a schematic diagram illustrating the essential parts of a substrate 4 in the present embodiment. In the present embodiment, the ejection port 2*b* in the seventh embodiment is replaced with an ejection port 2*c*. The cross section of an ejection port 2*a* is circular. The ejection port 2*c* has at least one projection projected from a circularly cross-sectional inner surface. In the present embodiment, the ejection port 2*c* has two projections 2*c*-1 and 2*c*-2 projecting toward the center thereof in such a manner as to approach each other. Since a structure such as a projection is formed at the ejection port 2*c*, the circulation flow of ink hardly intrudes even if the shape and cross-sectional area of the ejection port 2*c* are the same as those of the ejection port 2*a*, thus making the replacement of the ink difficult. However, fresh ink is supplied to the ejection port 2*c* formed upstream of the circulation channel 7 through a connection port 6B all the time, and therefore, even the ejection port 2*c* at which the circulation flow of ink hardly intrudes can achieve excellent ejection stability.

Auxiliary droplets (small droplets) of fine ink other than main droplets of ink are hardly ejected from an ejection port having a circular cross section with a projection formed at the inner surface thereof, like the ejection port 2*c*. Therefore, the ejection port 2*c* having the above-described configuration is effective in a print mode in which, for example, an image of a higher quality is printed (such as a photo mode). In the meantime, since an ejection port having a projection formed at the inner surface thereof has a high ink channel resistance, an ejection port having a circular cross section is effective in a high speed print mode. Moreover, it is preferable that the cross-sectional shape of an ejection port formed downstream of the circulation channel 7 be substantially more circular than that of an ejection port formed upstream of the circulation channel 7. Ejection ports formed into different shapes are arrayed in a high density and they are selectively used, thereby coping with both of a print mode in which an image of a high quality is printed and a high speed print mode.

Ninth Embodiment

The basic configuration of a print head 100 in the present embodiment is identical to that in the seventh embodiment, and therefore, the characteristic configuration of the present embodiment will be described below.

Figure 17:
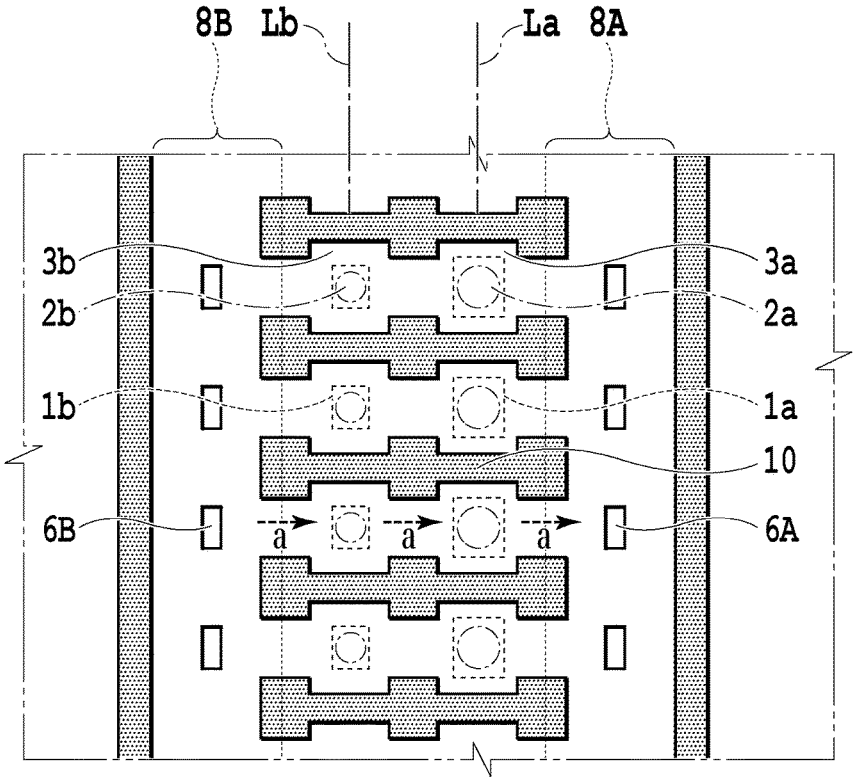
FIG. 17 is a diagram illustrating a substrate in a print head in a ninth embodiment of the present invention.

FIG. 17 is a schematic diagram illustrating the essential parts of a substrate 4 in the present embodiment. In the present embodiment, a channel forming member 10 defines a circulation channel of ink in which pressure chambers 3*a* and 3*b* corresponding to ejection ports 2*a* and 2*b* are connected in series via a single connection channel 5. In this manner, an interval between the pressure chambers 3*a* and 3*b* is reduced, so that the circulation channel of ink can be efficiently formed even in a print head having numerous ejection ports. Consequently, it is possible to reduce space required for forming the circulation channel of ink without an increase in proportion to the number of ejection ports.

Tenth Embodiment

The basic configuration of a print head 100 in the present embodiment is identical to that in the seventh embodiment, and therefore, the characteristic configuration of the present embodiment will be described below.

Figure 18A:
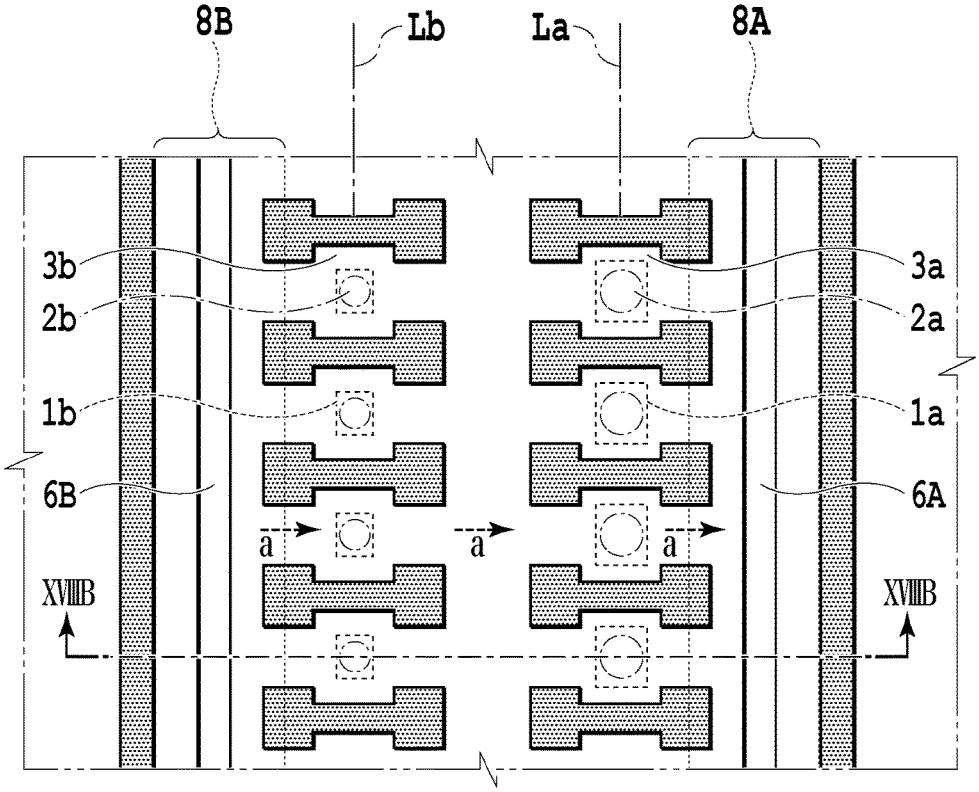
FIG. 18A is a diagram illustrating a substrate in a print head in a tenth embodiment of the present invention.
Figure 18B:
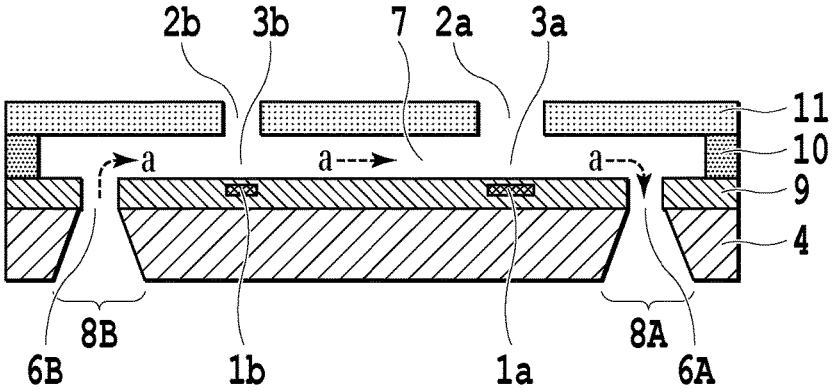
FIG. 18B is a cross-sectional view taken along a line XVIIIB-XVIIIB of FIG. 18A.

FIG. 18A is a schematic diagram illustrating the essential parts of a substrate 4 in the present embodiment; and FIG. 18B is a cross-sectional view taken along a line XVIIIB-XVIIIB of FIG. 18A. In the present embodiment, connection ports 6A and 6B are formed in a direction in which supply paths 8A and 8B extend, so that pressure chambers 3*a* and 3*b* are substantially linearly connected to the supply paths 8A and 8B. As a consequence, the channel resistance of ink between the supply paths 8A and 8B and the pressure chambers 3*a* and 3*b* is reduced, so that the ink can be more speedily supplied to the pressure chambers 3*a* and 3*b*.

Eleventh Embodiment

The basic configuration of a print head 100 in the present embodiment is identical to that in the tenth embodiment, and therefore, the characteristic configuration of the present embodiment will be described below.

Figure 19A:
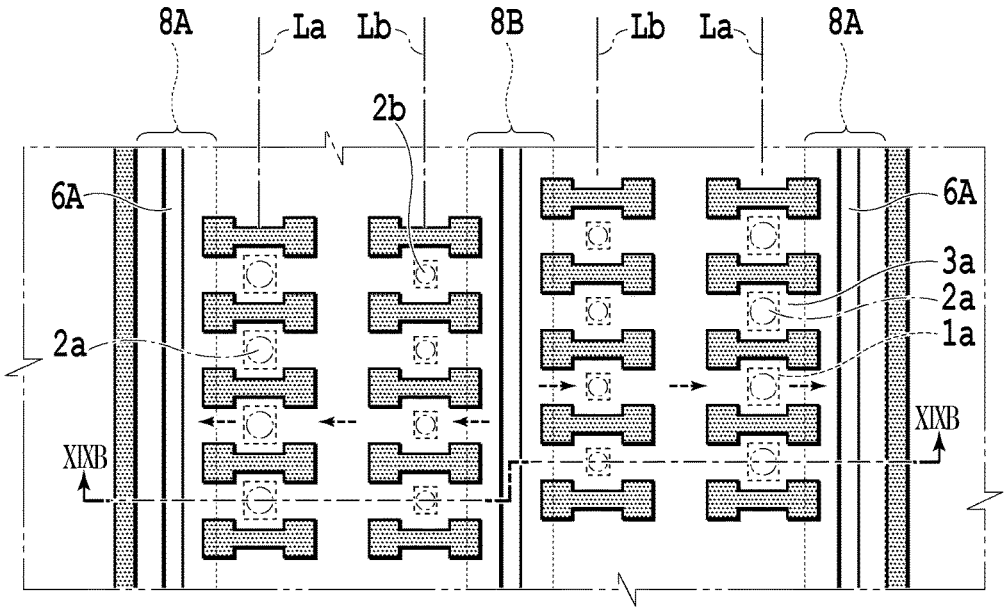
FIG. 19A is a diagram illustrating a substrate in a print head in an eleventh embodiment of the present invention.
Figure 19B:
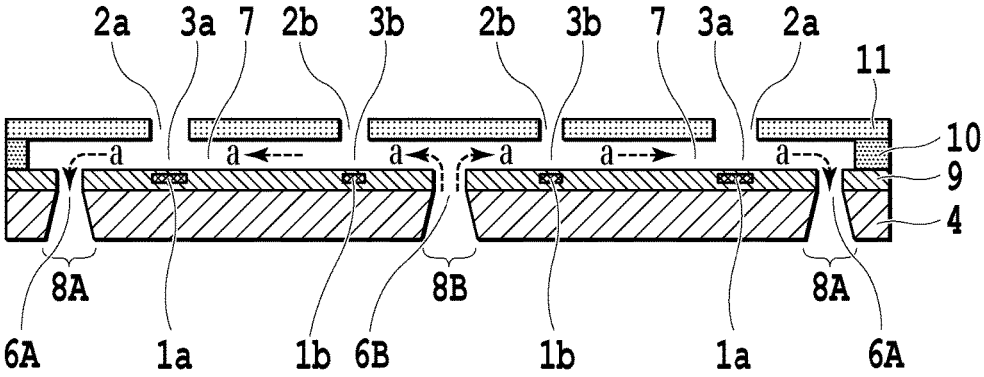
FIG. 19B is a cross-sectional view taken along a line XIXB-XIXB of FIG. 19A.

FIG. 19A is a schematic diagram illustrating the essential parts of a substrate 4 in the present embodiment; and FIG. 19B is a cross-sectional view taken along a line XIXB-XIXB of FIG. 19A. In the present embodiment, two groups, each consisting of the ejection port arrays La and Lb in the tenth embodiment illustrated in FIGS. 18A and 18B, are arranged laterally asymmetrically in FIG. 19A. A common supply path 8B and a connection port 6B extending along the supply path 8B are formed between the adjacent ejection port arrays Lb and Lb. In this manner, the supply path 8B is shared, thus reducing the size of the substrate 4 (a chip size).

(Constitutional Example of Ink Jet Printing Apparatus)

Figure 20A:
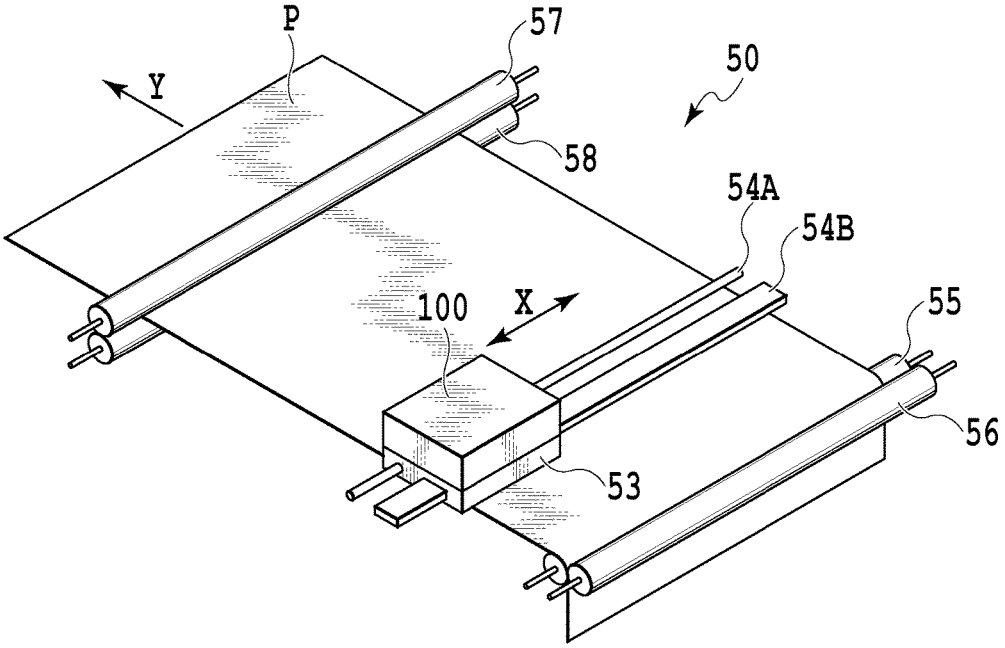
FIGS. 20A and 20B are diagrams illustrating a printing apparatus provided with the print head in the embodiments of the present invention.

The print heads (the liquid ejection heads) 100 in the above-described embodiments can be used in various ink jet printing apparatuses (liquid ejection apparatuses) of a so-called serial scan type, a full-line type, and the like. FIG. 20A illustrates a constitutional example of an ink jet printing apparatus of a serial scan type. On a carriage 53 that moves in a direction indicated by an arrow X in FIG. 20A (a main scan direction) is detachably mounted the print head 100 in the above-described embodiments. The carriage 53 is guided by guide members 54A and 54B, and a print medium P is conveyed in a direction indicated by an arrow Y (a sub scan direction) by rolls 55, 56, 57, and 58. By repeating operation in which the print head 100 ejects ink while moving in the main scan direction together with the carriage 53 and operation in which the print medium P is conveyed in the sub scan direction, an image is printed on the print medium P.

Figure 20B:
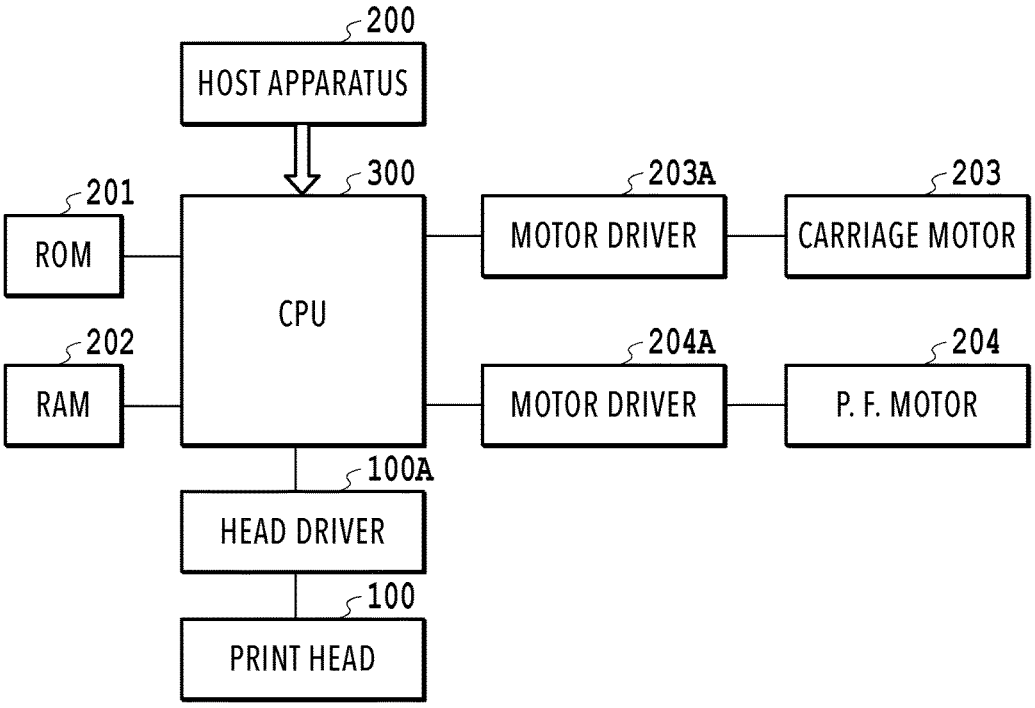

FIG. 20B is a block diagram illustrating a control system of the ink jet printing apparatus illustrated in FIG. 20A. A CPU (a control unit) 300 performs control processing of operation by the printing apparatus, data processing, and the like. A ROM 201 stores therein programs for their processing procedures and the like, whereas a RAM 202 is used as a work area at which the processing is performed. The heater 1 mounted on the print head 100 is driven by a head driver 100A. An image is printed by sending drive data (image data) on the heater 1 and a drive control signal (a heat pulse signal) to the head driver 100A. The CPU 300 controls a carriage motor 203 for driving the carriage 53 in the main scan direction via a motor driver 203A, and furthermore, controls a PF motor 204 for conveying the print medium P in the sub scan direction via a motor driver 204A. As described above, the CPU 300 controls the drive timing of the heater 1.

OTHER EMBODIMENTS

In the above-described embodiments, a thermal system for generating air bubbles in the ink by using the electrothermal transducer (the heater) has been adopted as the system for ejecting the ink as the liquid. However, various systems using a piezoelectric actuator, an electrostatic actuator, a mechanical/impact drive type actuator, a speech coil actuator, a magnetostriction drive type actuator, and the like may be adopted as the system for ejecting the ink.

The ink jet print head as the liquid ejection head may be widely applied to a serial type print head used in a so-called serial scan type printing apparatus in addition to an elongated print head (a line type head) according to the width of a print medium. Moreover, a serial type print head may be configured to, for example, mount one substrate for black ink and one substrate for each color ink thereon. In addition, a plurality of substrates may be arranged in such a manner that ejection ports formed on adjacent substrates overlap in the direction of ejection port arrays. Moreover, an ink jet printing apparatus may be configured to scan a print medium by the use of a shorter line type head than the width of the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127563 filed Jun. 29, 2017, which is hereby incorporated by reference herein in its entirety.

What is claimed is:

1. A liquid ejection head comprising:

a substrate having a first surface and a second surface opposite to the first surface;

a circulation channel provided on a side of the first surface of the substrate;

a pressure chamber provided on the side of the first surface of the substrate, liquid being circulated through the pressure chamber; and an ejection energy generating element provided on the side of the first surface of the substrate, the ejection energy generating element generating energy for ejecting liquid in the pressure chamber from an ejection port of the liquid ejection head, wherein the substrate includes:

a penetration supply path configured to penetrate between the first surface and second surface of the substrate so as to supply liquid to the circulation channel; and a penetration recovery path configured to penetrate between the first surface and the second surface of the substrate so as to recover liquid from the circulation channel, wherein the pressure chamber is provided in plural number in series in the circulation channel, wherein the circulation channel includes the plural pressure chambers, a first supply path configured to supply liquid, having a first pressure, to a first position of the circulation channel, and a second supply path configured to supply liquid, having a second pressure different from the first pressure, to a second position of the circulation channel different from the first position, and wherein the circulation channel includes a connection channel positioned between the first surface of the substrate and the ejection port, the connection channel being configured to allow the plurality of pressure chambers to communicate therewith.

2. The liquid ejection head according to claim 1, wherein the first position is one end of the circulation channel whereas the second position is the other end of the circulation channel.

3. The liquid ejection head according to claim 1, wherein at least either one of the first position and the second position is formed in plural number.

4. The liquid ejection head according to claim 1, further comprising a flow mechanism configured to allow liquid in the circulation channel to flow.

5. The liquid ejection head according to claim 1, wherein the number of pressure chambers provided in series in the circulation channel is three or more.

6. The liquid ejection head according to claim 1, wherein the ejection port is provided in plural number, the ejection ports being arrayed so as to form ejection port arrays, and the ejection ports respectively corresponding the pressure chambers provided in series in the circulation channel are positioned on the same ejection port array.

7. The liquid ejection head according to claim 1, wherein the ejection port is provided in plural number, the ejection ports being arrayed so as to form ejection port arrays, and the ejection ports respectively corresponding to the pressure chambers provided in series in the circulation channel are positioned on different ejection port arrays.

8. The liquid ejection head according to claim 1, wherein in the circulation channel, the channel resistance of liquid flowing at one end side is different from that of liquid flowing at the other end side.

9. The liquid ejection head according to claim 1, wherein in the connection channel, channel resistance of liquid that flows in one direction is different from that of liquid that flows in the other direction.

10. The liquid ejection head according to claim 1, wherein the ejection port is formed plural in number and the plurality of ejection ports include a first ejection port having a first opening area and a second ejection port having a second opening area greater than that of the first opening area, the first ejection port being positioned more upstream of the circulation channel than the second ejection port.

11. The liquid ejection head according to claim 1, wherein the ejection port is formed plural in number and the plurality of the ejection ports are arrayed so as to form ejection port arrays, and the ejection port arrays are formed along the circulation channel.

12. The liquid ejection head according to claim 1, wherein the number of pressure chambers provided in series in the circulation channel is five or less.

13. A liquid ejection apparatus comprising:

the liquid ejection head according to claim 1;

a supply unit configured to supply liquid to the circulation channel of the liquid ejection head; and a control unit configured to control the ejection energy generating element.

14. The liquid ejection head according to claim 1, wherein the connection channel allows the plurality of pressure chambers to communicate therewith without communicating through the ejection port.

15. The liquid ejection head according to claim 1, wherein the first position of the circulation channel comprises a first connection port of the first supply path whereas the second position of the circulation channel comprises a second connection port of the second supply path, the penetration supply path is open to the second supply path, and the penetration recovery path is open to the first supply path.

16. The liquid ejection head according to claim 1, wherein the connection channel allows the plurality of pressure chambers to communicate therewith without communicating through the ejection port, the first position of the circulation channel comprises a first connection port of the first supply path whereas the second position of the circulation channel comprises a second connection port of the second supply path, the penetration supply path is open to the second supply path, and the penetration recovery path is open to the first supply path.

* * * * *